US011716793B2

(12) United States Patent
Connors

(10) Patent No.: US 11,716,793 B2
(45) Date of Patent: Aug. 1, 2023

(54) COMPACT MICROWAVE OVEN

(71) Applicant: Robert W. Connors, Lake Barrington, IL (US)

(72) Inventor: Robert W. Connors, Lake Barrington, IL (US)

( * ) Notice: Subject to any disclaimer, the term of this patent is extended or adjusted under 35 U.S.C. 154(b) by 0 days.

(21) Appl. No.: 13/746,876

(22) Filed: Jan. 22, 2013

(65) Prior Publication Data

US 2013/0186888 A1 Jul. 25, 2013

Related U.S. Application Data

(60) Provisional application No. 61/589,661, filed on Jan. 23, 2012.

(51) Int. Cl.
*H05B 6/64* (2006.01)
*H05B 6/80* (2006.01)

(52) U.S. Cl.
CPC ..... *H05B 6/6402* (2013.01); *H05B 6/80* (2013.01)

(58) Field of Classification Search
CPC . H05B 6/705; H05B 6/68; H05B 6/64; H05B 6/687; H05B 2206/044
USPC ..... 219/620, 660, 695–697, 702, 704, 705, 219/709–718, 725, 745–750, 756, 758, 219/760, 761, 762
See application file for complete search history.

(56) References Cited

U.S. PATENT DOCUMENTS 1,949,222 A * 2/1934 Spitzglass ..... G05D 23/2039 200/56 A
2,493,857 A * 1/1950 Cargill ..... A21B 1/48 198/798
2,827,537 A * 3/1958 Haagensen ..... H05B 6/745 219/750
3,191,046 A * 6/1965 Savalli ..... H01P 1/30 250/206
3,196,243 A * 7/1965 Schall ..... H05B 6/6482 219/740
3,241,064 A * 3/1966 Bartels ..... G01R 23/00 324/76.24
3,304,400 A * 2/1967 Ojelid ..... H05B 6/6402 219/761
3,308,390 A * 3/1967 Crapuchettes ..... H05B 6/6402 327/593
3,320,396 A * 5/1967 Boehm ..... H05B 6/705 219/685
3,377,562 A * 4/1968 Staats ..... H01J 23/48 315/5.13

(Continued)

FOREIGN PATENT DOCUMENTS

FR 2 507 296 12/1982

OTHER PUBLICATIONS

International Search Report PCT/US2013/022531 dated Oct. 11, 2013—10 pages.

(Continued)

*Primary Examiner* — Eric S Stapleton
(74) *Attorney, Agent, or Firm* — K&L Gates LLP

(57) ABSTRACT

In an embodiment a microwave oven includes (i) a housing including two surfaces upon which the microwave oven can be set for operation; (ii) a magnetron located inside the housing; a door hinged along a hinged surface of the housing; and (iii) a user interface located on a surface of the housing opposing the hinged surface.

36 Claims, 8 Drawing Sheets

(56) References Cited

U.S. PATENT DOCUMENTS 3,557,333 A * 1/1971 McAvoy ..... H03B 9/143 219/748
3,710,065 A * 1/1973 Crapuchettes ..... H05B 6/666 219/715
3,780,252 A * 12/1973 Crapuchettes ..... H03B 9/10 219/716
3,967,156 A * 6/1976 Levie ..... H02M 7/06 315/101
3,974,696 A * 8/1976 Fitzmayer ..... A47J 37/00 374/155
3,975,720 A * 8/1976 Chen ..... F24C 7/02 219/712
4,049,938 A * 9/1977 Ueno ..... H05B 6/642 219/711
4,076,996 A * 2/1978 Maehara ..... H02H 3/24 315/106
4,103,431 A * 8/1978 Levinson ..... F26B 3/347 219/712
4,142,082 A * 2/1979 Israel ..... H03B 9/10 219/715
4,149,057 A * 4/1979 Fritts ..... H05B 6/666 219/715
4,154,861 A * 5/1979 Smith ..... A21B 1/245 126/21 A
4,158,431 A * 6/1979 Van Bavel ..... H05B 6/6482 340/309.4
4,158,432 A * 6/1979 Van Bavel ..... H05B 6/6482 219/492
4,162,380 A 7/1979 Burke
4,171,667 A * 10/1979 Miller ..... G07F 11/70 219/400
4,177,369 A * 12/1979 Fritts ..... G05B 19/104 219/716
4,188,520 A * 2/1980 Dills ..... H05B 6/6435 219/486
4,190,756 A * 2/1980 Foerstner ..... H05B 6/687 219/718
4,227,062 A * 10/1980 Payne ..... H05B 6/6452 219/486
4,242,554 A * 12/1980 Hurko ..... H05B 6/6452 219/486
4,246,462 A * 1/1981 Meisel ..... A21B 1/48 219/697
4,275,464 A * 6/1981 Schmidt ..... G05B 19/0428 68/12.01
4,288,118 A * 9/1981 Ohkado ..... F24C 15/022 292/201
4,289,792 A * 9/1981 Smith ..... A23L 3/005 219/682
4,295,027 A * 10/1981 Zushi ..... H05B 6/6452 219/712
4,297,557 A * 10/1981 Tyler ..... F24C 7/02 219/713
4,332,992 A * 6/1982 Larsen ..... H05B 6/6435 126/21 A
4,336,433 A * 6/1982 Yokozeki ..... G05D 22/02 219/707
4,338,911 A * 7/1982 Smith ..... A21B 1/245 126/21 A
4,350,858 A * 9/1982 Yoshida ..... H05B 6/66 219/506
4,356,370 A * 10/1982 Horinouchi ..... H05B 6/687 219/492
4,363,957 A * 12/1982 Tachikawa ..... H05B 6/6482 219/497
4,366,357 A * 12/1982 Satoh ..... H05B 6/6411 219/682
4,378,487 A * 3/1983 Maeda ..... G05B 19/102 219/506
4,390,766 A * 6/1983 Horinouchi ..... H05B 6/6452 219/506
4,401,884 A * 8/1983 Kusunoki ..... F24C 7/08 219/492
4,403,302 A * 9/1983 Young ..... G05B 9/02 219/492
4,408,299 A * 10/1983 Young ..... G06F 11/1441 340/309.8
4,409,453 A * 10/1983 Smith ..... A23L 3/10 219/684
4,418,261 A * 11/1983 Jailor ..... H05B 6/6423 126/21 A
4,427,876 A * 1/1984 Bonacorsi ..... A47J 37/0623 200/DIG. 18
4,436,356 A * 3/1984 Stelling ..... H05B 6/6402 108/93
4,446,349 A * 5/1984 Smith ..... H05B 6/74 219/747
RE31,864 E * 4/1985 van Bavel ..... G05B 19/0428 340/309.4
4,508,948 A * 4/1985 Carlson ..... G01G 19/56 219/708
4,521,658 A * 6/1985 Wyland ..... H05B 6/6435 177/144
4,525,615 A * 6/1985 Wyland ..... H05B 6/6435 219/703
4,529,855 A * 7/1985 Fleck ..... H05B 6/64 219/720
4,533,809 A * 8/1985 Eke ..... H05B 6/645 219/681
4,571,581 A * 2/1986 Smith ..... H05B 6/6432 219/737
4,580,025 A * 4/1986 Carlson ..... H05B 6/6435 219/702
4,586,516 A * 5/1986 Turner ..... A61N 1/403 219/702
4,589,423 A * 5/1986 Turner ..... A61N 1/403 219/697
4,591,681 A * 5/1986 Akao ..... G09G 3/06 219/506
4,715,727 A * 12/1987 Carr ..... A23L 3/01 219/693
4,717,802 A * 1/1988 Colato ..... H05B 6/6411 126/41 A
4,777,575 A * 10/1988 Yamato ..... H05B 6/666 363/21.1
4,796,784 A * 1/1989 Spirk ..... A23G 9/00 222/252
4,807,808 A * 2/1989 Reed ..... A01K 1/033 119/168
4,818,550 A * 4/1989 Davidson ..... A23B 4/021 426/281
4,880,955 A * 11/1989 Nitzinger ..... A21B 3/10 219/758
4,904,837 A * 2/1990 Low ..... H05B 6/685 219/717
4,978,826 A * 12/1990 DeRuiter ..... H05B 6/50 219/771
5,051,701 A * 9/1991 Kashimoto ..... G01K 7/003 219/494
5,070,223 A * 12/1991 Colasante ..... H05B 6/64 219/679
5,073,167 A * 12/1991 Carr ..... A61M 1/369 219/687
RE33,791 E * 1/1992 Carr ..... A23L 3/01 219/710
5,107,086 A * 4/1992 Yangas ..... H05B 6/64 126/569
5,107,088 A * 4/1992 Aoki ..... G04C 3/007 219/719
5,252,797 A * 10/1993 Komatsu ..... H05B 6/642 219/729
5,270,510 A * 12/1993 Aoki ..... H05B 6/66 219/706
5,286,938 A * 2/1994 Takei ..... H05B 6/683 219/715
5,318,754 A * 6/1994 Collins ..... B01J 19/126 219/710

(56) References Cited

U.S. PATENT DOCUMENTS 5,321,229 A * 6/1994 Holling ..... F24C 7/087 219/445.1
5,347,108 A 9/1994 Minakawa et al.
5,349,138 A 9/1994 Dong
5,349,162 A * 9/1994 Holling ..... F24C 7/082 219/445.1
5,378,874 A * 1/1995 Holling ..... F24C 7/082 219/414
5,417,941 A * 5/1995 McNulty ..... A61L 2/12 219/682
5,468,938 A * 11/1995 Roy ..... A01M 1/226 219/690
5,478,987 A * 12/1995 Morita ..... H05B 6/6458 219/705
5,491,323 A * 2/1996 Mori ..... H05B 6/645 219/494
5,503,300 A * 4/1996 Prescott ..... G07F 9/026 221/105
5,548,103 A * 8/1996 Morita ..... H05B 6/6458 219/703
5,615,380 A * 3/1997 Hyatt ..... B60R 16/0373 345/520
5,624,592 A * 4/1997 Paustian ..... H05B 6/80 219/679
5,653,778 A 8/1997 Rutjes et al.
5,724,244 A 3/1998 Yabuki
5,748,104 A * 5/1998 Argyroudis ..... G08C 17/02 340/870.02
5,796,081 A 8/1998 Carlsson et al.
5,799,822 A * 9/1998 Rudewicz ..... G07F 9/026 219/678
5,892,758 A * 4/1999 Argyroudis ..... G08C 17/02 340/870.02
5,948,309 A 9/1999 Nelson et al.
5,968,401 A * 10/1999 Roy ..... A01M 1/226 219/679
5,973,304 A * 10/1999 Kim ..... H05B 6/642 219/702
5,973,305 A 10/1999 Kim et al.
5,973,306 A 10/1999 Lee
5,986,634 A * 11/1999 Alioshin ..... G06F 1/1616 345/649
6,008,482 A 12/1999 Takahashi et al.
6,013,909 A 1/2000 Aramaki et al.
6,043,461 A * 3/2000 Holling ..... F24C 7/087 219/445.1
6,045,618 A * 4/2000 Raoux ..... B01D 45/06 118/715
6,049,071 A 4/2000 Le Van Suu
6,054,694 A * 4/2000 Paustian ..... H05B 6/686 219/679
6,060,700 A 5/2000 Perlman et al.
6,080,270 A * 6/2000 Tabrez ..... H01J 37/32229 118/723 ME
6,091,029 A 7/2000 Lee
6,111,237 A * 8/2000 Paustian ..... H02G 13/20 219/687
6,137,426 A * 10/2000 Roth ..... H04M 1/23 341/20
6,166,496 A * 12/2000 Lys ..... H05B 33/0857 315/292
6,172,346 B1 * 1/2001 Wroe ..... B01J 19/126 219/681
6,187,072 B1 * 2/2001 Cheung ..... B01D 45/06 118/715
6,193,802 B1 * 2/2001 Pang ..... B01D 45/06 118/715
6,211,626 B1 * 4/2001 Lys ..... A61N 5/0616 315/291
6,251,493 B1 * 6/2001 Johnson ..... F16F 1/37 428/220
6,292,901 B1 * 9/2001 Lys ..... A61N 5/0616 713/300
D449,761 S 10/2001 Loftis et al.
6,313,450 B1 * 11/2001 Han ..... H05B 6/666 219/702
6,331,699 B1 * 12/2001 Ito ..... H05B 6/666 219/715
6,433,324 B1 8/2002 Kim
6,459,919 B1 * 10/2002 Lys ..... A61N 5/0616 315/291
6,469,286 B1 * 10/2002 Nobue ..... H05B 6/705 219/746
6,472,647 B2 10/2002 Lee et al.
6,528,954 B1 * 3/2003 Lys ..... A61N 5/0616 315/158
6,539,840 B2 4/2003 Choi et al.
6,734,407 B1 5/2004 Abbott
6,737,620 B2 5/2004 Kim
6,759,636 B2 7/2004 Stutman
6,770,859 B2 8/2004 Kang
6,772,678 B2 8/2004 Choi et al.
6,867,404 B2 3/2005 Lee et al.
6,921,887 B2 7/2005 Back et al.
6,998,590 B2 * 2/2006 Reale ..... H05B 6/6494 219/678
7,012,231 B2 * 3/2006 Reale ..... H05B 6/6494 219/756
7,022,956 B2 4/2006 Greenstreet
7,069,091 B2 6/2006 Williamson
7,133,739 B2 11/2006 Katayama et al.
7,186,960 B2 3/2007 Cho et al.
7,202,452 B2 4/2007 Park et al.
7,214,914 B1 * 5/2007 Isaksson ..... F24C 7/08 219/710
7,332,057 B2 * 2/2008 Isom ..... B01D 1/0017 159/44
7,348,527 B2 * 3/2008 Braunisch ..... H05B 6/6423 126/21 A
7,361,871 B2 4/2008 Cho et al.
7,446,290 B2 11/2008 Park et al.
7,525,074 B2 4/2009 Bostick et al.
7,652,232 B2 1/2010 Kim et al.
7,687,749 B2 3/2010 Ochiai et al.
7,703,379 B2 4/2010 Kim et al.
7,931,683 B2 * 4/2011 Weber ..... A61L 31/088 623/1.42
8,124,920 B1 * 2/2012 Weber ..... H05B 6/6411 219/708
8,362,906 B1 * 1/2013 Glassman ..... H04N 21/42204 219/714
8,367,990 B2 2/2013 Miller et al.
8,502,125 B2 8/2013 Danzer et al.
8,610,038 B2 12/2013 Hyde et al.
8,759,727 B2 * 6/2014 Gard ..... H05B 6/6491 219/678
8,847,130 B2 * 9/2014 Niwa ..... H05B 6/802 123/142.5 E
8,934,994 B1 * 1/2015 Lee ..... G05B 19/4099 700/47
8,948,579 B2 * 2/2015 Lee ..... F24C 7/04 392/418
9,730,279 B2 8/2017 Li et al.
9,907,122 B2 2/2018 Himmelein et al.
10,233,009 B2 3/2019 Ishikawa et al.
2001/0009256 A1 * 7/2001 Nasu ..... F24C 7/082 219/739
2001/0028227 A1 * 10/2001 Lys ..... A61N 5/0616 315/317
2001/0045430 A1 * 11/2001 Mawoud ..... H05B 6/6402 219/756
2002/0014486 A1 * 2/2002 Chun ..... G07C 3/04 219/702
2002/0047646 A1 * 4/2002 Lys ..... H05B 33/0803 315/312
2002/0053565 A1 * 5/2002 Lee ..... H05B 6/642 219/757

(56) References Cited

U.S. PATENT DOCUMENTS

2002/0153370 A1* 10/2002 Stutman ..... B60N 3/16 219/715
2003/0076281 A1* 4/2003 Morgan ..... F24C 7/004 345/44
2003/0117092 A1* 6/2003 Jang ..... H05B 6/666 315/501
2004/0155609 A1* 8/2004 Lys ..... H05B 33/0803 315/292
2004/0251252 A1* 12/2004 Reale ..... H05B 6/6494 219/756
2005/0063194 A1* 3/2005 Lys ..... B60Q 1/2696 362/545
2005/0167424 A1* 8/2005 Reale ..... H05B 6/6494 219/756
2005/0173423 A1* 8/2005 Ho Lee ..... H05B 6/666 219/702
2005/0190160 A1* 9/2005 Wang ..... G06F 1/1616 345/168
2005/0215764 A1* 9/2005 Tuszynski ..... C07K 14/435 530/358
2005/0249667 A1* 11/2005 Tuszynski ..... A61B 8/08 424/9.3
2005/0264521 A1* 12/2005 Liu ..... H04B 1/202 345/156
2005/0269316 A1* 12/2005 Monteleone ..... F01K 15/02 219/688
2006/0034728 A1* 2/2006 Kloepfer ..... A61B 5/14532 422/68.1
2006/0096979 A1* 5/2006 Kaneko ..... H05B 6/725 219/749
2007/0068939 A1* 3/2007 Harris ..... A21B 1/48 219/761
2007/0076326 A1* 4/2007 Ito ..... G11B 5/024 360/281.6
2007/0095823 A1* 5/2007 Sedlmayr ..... H05B 6/72 219/688
2007/0188427 A1* 8/2007 Lys ..... H05B 33/0857 345/82
2007/0251936 A1* 11/2007 Nam ..... F24C 15/166 219/413
2007/0278219 A1* 12/2007 Claesson ..... A21B 1/245 219/702
2007/0295718 A1* 12/2007 Takei ..... H05B 6/80 219/756
2008/0008072 A1* 1/2008 Ito ..... B29B 17/02 369/53.21
2008/0030836 A1* 2/2008 Tonar ..... B60R 1/084 359/271
2008/0108122 A1* 5/2008 Paul ..... B01F 5/0475 435/183
2008/0116198 A1* 5/2008 Frank ..... H05B 6/6426 219/678
2008/0117782 A1* 5/2008 Ito ..... G11B 5/0245 369/53.21
2008/0290087 A1* 11/2008 Ben-Shmuel ..... A23L 3/01 219/748
2008/0302657 A1* 12/2008 Luten ..... C23C 14/086 204/298.36
2008/0310005 A1* 12/2008 Tonar ..... B60R 1/00 359/265
2008/0310995 A1* 12/2008 Charm ..... A61L 2/0023 422/21
2009/0045191 A1* 2/2009 Ben-Shmuel ..... H05B 6/647 219/746
2009/0147413 A1* 6/2009 Aoki ..... F24C 7/08 361/42
2009/0188912 A1* 7/2009 Kanbara ..... H05B 6/6414 219/702
2009/0236334 A1* 9/2009 Ben-Shmuel ..... B65D 81/3453 219/703
2009/0236335 A1* 9/2009 Ben-Shmuel ..... H05B 6/6447 219/710
2010/0051612 A1* 3/2010 Fagrell ..... B01J 19/126 219/748
2010/0089250 A1* 4/2010 De Heij ..... A23L 3/225 99/451
2010/0089909 A1* 4/2010 Besore ..... G06Q 50/06 219/720
2010/0115785 A1* 5/2010 Ben-Shmuel ..... D06F 58/266 34/260
2010/0149377 A1* 6/2010 Shintani ..... H04N 5/772 348/222.1
2010/0215903 A1* 8/2010 Tonar ..... B60R 1/084 428/141
2010/0230404 A1* 9/2010 Sigler ..... A47J 37/0772 219/732
2010/0259561 A1* 10/2010 Forutanpour ..... G06F 3/0216 345/660
2010/0272956 A1* 10/2010 Miyairi ..... A47B 91/04 428/139
2011/0002028 A1* 1/2011 Luten ..... B60R 1/00 359/267
2011/0146607 A1* 6/2011 Smith ..... F02P 9/007 123/143 B
2011/0166830 A1* 7/2011 Lehmann ..... H05B 1/0244 702/190
2011/0175691 A1* 7/2011 Smith ..... F02P 9/007 333/222
2011/0227487 A1* 9/2011 Nichol ..... G02B 6/0018 315/158
2011/0255303 A1* 10/2011 Nichol ..... G02B 6/0018 362/606
2011/0259880 A1* 10/2011 Petrenko ..... H05B 1/0236 219/660
2011/0273906 A1* 11/2011 Nichol ..... G02B 6/0076 362/607
2012/0000903 A1* 1/2012 Baarman ..... A47J 27/002 219/620
2012/0034350 A1* 2/2012 Gard ..... H05B 6/6411 426/242
2012/0056000 A1* 3/2012 Shores ..... A61J 7/0436 235/492
2012/0061384 A1* 3/2012 Kasai ..... H01L 21/324 219/718
2012/0138602 A1* 6/2012 Hirano ..... H05B 6/687 219/719
2012/0180985 A1* 7/2012 Sundhar ..... F25D 31/005 165/63
2012/0218799 A1* 8/2012 Furukawa ..... H05B 6/72 363/126
2012/0297990 A1* 11/2012 Sonder ..... A23B 4/01 99/451
2013/0008893 A1* 1/2013 Little ..... H05B 6/6435 219/702
2013/0155723 A1* 6/2013 Coleman ..... G02B 6/0011 362/621

OTHER PUBLICATIONS

Written Opinion PCT/US2013/022531 dated Oct. 11, 2013—20 pages.
EP Office Action Application No. 13 705 045.6-1202 dated Mar. 13, 2020—54 pages.
IPRP—PCT/US2013/022531 mailing date May 20, 2014—8 pages.

* cited by examiner

COMPACT MICROWAVE OVEN

PRIORITY CLAIM

This application claims priority to and the benefit of U.S. Provisional Patent Application Ser. No. 61/589,661, entitled, "Compact Microwave Oven", filed Jan. 23, 2012, the entire contents of which are incorporated herein be reference and relied upon.

BACKGROUND

The present disclosure relates to food heating and in particular to the microwaving of food.

For many reasons, it is desirable to have a way to reheat food using a microwave oven. First, it can be expensive to go out to eat, especially on a regular basis. Second, food prepared at home is often prepared with care and is worth saving for a later meal. Third, food prepared in a microwave can be done quickly and at a time that is convenient for the user.

There are a number of drawbacks to current microwaves, especially microwaves used at an office or other workplace. The microwaves are often located in a kitchen or other centralized workplace location, so that the user has to transport unheated food to the microwave, wait while the food is heated, and carry the food back to the user's office or other area to eat. The person may have to wait in line for the microwave to become open for use. After the food is heated in the microwave, the person may have to transport the heated food through the office or workplace, which may be uncomfortable or even frowned upon.

It is believed that a microwave that can be easily stored and used in a person's office or personal workspace would be welcome. The current size of microwaves makes such use impractical. Current microwaves are typically too large to be stored out of sight, for example, behind a drawer or cabinet. The current size and weight of microwaves also makes the transportation of the microwave to the office difficult.

A need for an improved microwave is needed accordingly.

SUMMARY

An improved microwave oven is provided. The microwave oven is relatively small and lightweight. The microwave oven can be readily transported to the user's office or on travel, e.g., in a backpack, briefcase, suitcase or other bag. The microwave is small and lightweight enough to be removed from an out of the way storage place, used and returned to the storage place. The microwave is sized and weighted such that it can be readily stored in a person's office or cubicle. It is well suited to bring on trips, e.g., on vacation or camping. In one embodiment the microwave is about the size of a shoebox.

One issue making the current size of microwaves too large for individualized or compact use is that they need to be sized to handle different containers. Certain frozen meals are flat and consume a relatively large area in a horizontal or x-y plane but relatively little area in the vertical or z-direction. Other microwaveable meals, such as soups or food stored in plastic containers extend further in the z-direction. The microwave has to be able to accommodate these different food storage arrangements, meaning that microwave space is often unnecessarily large in a certain direction based upon the food container used.

The present microwave oven is structured and arranged such that it can be stably positioned for use in multiple orientations. In one orientation, the microwave oven is positioned to receive a flat, horizontally disposed food item, such as a frozen food tray. In this orientation, the door to the microwave can open from the top of the oven for example. The food item is loaded into the top of the microwave, after which the door closes, e.g., hinges closed, over the top of the food item.

In another orientation, the microwave is constructed to receive a food item that is more vertically positioned, so as to be able to receive a cup, bowl or plastic food storage container that is mainly vertically oriented. In this second orientation, the microwave door can open from a side of the microwave for example. Here, the food item is loaded into the side of the microwave, after which the door closes, e.g., hinges across the side of the food item.

The top-loading and side-loading orientations enable the microwaveable space to be used efficiently regardless of the type of food item (x-y horizontal or z-direction vertical as described above) loaded into the microwave oven. Also, the dual loading potential allows the food item to be placed inside the microwave in its most appropriate or recommended orientation. For example, the x-y horizontal food item may contain a tray having different compartments each carrying a different food item, e.g., a main course, a side dish and a dessert. Loading that tray vertically into a microwave oven instead of horizontally allows the food items to potentially flow out of their respective compartments. The present microwave oven allows for efficient microwave space usage and for the food items to be loaded in their intended orientations.

The present microwave oven includes a number of features that enable and/or enhance the dual orientation operation of the oven. It should be appreciated that the below listed features can be provided in any combination and do not have to be provided with the dual orientation operation feature. First, one corner of the microwave oven will be a lower corner of the microwave (corner that contacts a table or other item upon which the microwave sits) regardless of which orientation that the oven is placed. It is contemplated to locate the heaviest components of the microwave oven at or near that corner. For example, the transformer and other heavy electronics can be located in the common corner.

Second, feet, such as four frictional, impact-absorbing, e.g., rubber, feet can be placed on both bottom surfaces of the microwave including the x-y horizontal bottom and the z-direction bottom. The frictional, impact-absorbing, e.g., rubber, feet help prevent the microwave from sliding, which is more likely given the light weight of the microwave. The feet help to prevent damage to the microwave in the event that the oven tips over onto the surface having the feet. The feet also serve as visual cues to the user indicating the different orientations in which the microwave can be positioned.

Third, in the event that the microwave has a side that is prone to causing the microwave to tip if pushed, it is contemplated to place the user interface, which can include a touch screen and/or membrane switches and a display, on a different side. For example, if the microwave has three dimensions a, b and c, where a and b are relatively long compared to c, it is contemplated to place the user interface in on a surface of the microwave oven formed by the a-c or b-c dimensions, but not the a-b dimension. Touching a button placed on the a-b surface may cause the microwave to tip because the depth c extending back for the a-b surface is relatively small. Conversely, touching a button on the a-c or b-c surface will be resisted by the longer depth b or a, respectively. In this manner, button pressing, assuming a normal button press force, will not cause the microwave oven to tip.

Fourth, the user interface in one embodiment is set at a forty-five degree angle in both the x-y horizontal and z-direction orientations. In this manner, the user never has to look at letters and numbers that are at ninety-degrees to the user's normal line of sight. The letters and numbers are always somewhat right-side-up. The user interface can include a digital display, e.g., countdown timer display, such as a liquid crystal display ("LCD"), light emitting diode ("LED") display, electroluminescent display ("ELD"), or plasma display. The buttons of the user interface for operating the microwave oven can be easily cleanable and wipeable membrane switches.

In another user interface embodiment, the user interface rotates in response to the orientation in which the microwave oven is placed, so that numbers displayed, e.g., digits for cooking time entry, are oriented right-side-up regardless. The user interface may have a digital display, which can be of any of the types listed above, and electromechanical operator buttons, such as membrane switches. The display is operated upon by electronics and/or software programming to display characters right-side-up regardless of which orientation that the oven is positioned. The electromechanical buttons in one embodiment are positioned so as to display indicia to be readily recognizable in any orientation of use.

The user interface may alternatively have a video monitor operable with a touch screen overlay. The buttons to operate the microwave oven are accordingly touch screen or virtual buttons. The countdown timer display and the touch screen buttons are repositioned and re-oriented depending upon which orientation that the microwave is placed for use. Thus the positioning of the buttons, e.g., the "time entry", "start" and "stop" buttons, relative to the display can be maintained for example from left to right beneath the countdown timer display. Or, the user interface can be reconfigured to optimize the overall footprint up switching orientations. In either situation, each button is presented right-side-up regardless of the orientation that the microwave is used.

In one implementation, a mercury or other type of gravity switch is used to sense the orientation of use that has been selected. The output of the switch is used to control the orientation of the display. In another implementation, the display orientation is controlled by a contact closure, which is physically closed by the weight of the microwave oven when placed into a particular orientation for use. For example, one of the impact-absorbing functional, e.g., rubber feet can include a spring-loaded contact switch that is compressed closed when the weight of the microwave is applied, and wherein the spring is biased such that the contact is forced open when weight is removed from the foot. The microwave can include one or more of the contact closure feet on one or both of the potential base surfaces of the microwave oven.

Logic control of the orientation of the user interface in the contact switch implementation depends upon how many contact closure feet are provided. For example, the user interface could be displayed in a default position, e.g., right-side-up, for the x-y horizontal orientation. A single contact closure foot is provided on the base surface for the other, z-direction orientation. When that contact is closed, the control electronics and/or programming cause the orientation of the display to change so as to be right-side-up for the z-direction orientation of the microwave oven. When the microwave is lifted so that the single contact is no longer compressed, the spring forces the contact to open, and the control electronics and/or programming causes the display to revert back to the default orientation. Multiple contact closure feet can be provided on the base surface of the z-direction orientation for signal redundancy and/or in case one of the switches becomes inoperable.

If one or more contact closure foot is provided one both base surfaces, then the control electronics and/or programming orients the display based upon which surface has a contact closure. As discussed in more detail below, it is contemplated to run the microwave on rechargeable battery power. Here especially, but in any implementation, it is contemplated to only display the user interface display, and to only allow the microwave oven to be operated when at least one contact closure is made via one of the base feet.

The spring-loaded contacts do not have to be provided as part of an impact-absorbing, frictional foot. That is, even if the feet are not provided, the spring loaded contacts can still be implemented as moveable tabs or members in one or both of the base surfaces. In yet another alternative embodiment, a tray defining the microwaveable area is allowed to float slightly to close one or more electrical contact in any of the manners just described to indicate which base surface has been selected. In still a further alternative embodiment, a button or other type of input device is provided that allows the user to select the orientation that the user interface is displayed.

Fifth, the microwave oven can be configured to run on alternating current ("AC") power alone or to run alternatively on AC power or direct current ("DC") power via a rechargeable battery that is recharged via AC power. In either case, an AC socket or plug is provided. It is contemplated to provide the AC socket or plug on a surface of the microwavable that is not one of the x-y horizontal or z-directional base surfaces. The socket can be provided on a side or surface that opposes the user interface side or surface for example. In this manner, the microwave oven can be reoriented even while a power cord is plugged into the socket or the plug of the microwave is plugged into an external source.

The microwave oven includes a control unit having an AC detection circuit that is modified in one embodiment to use AC power as long as the microwave is connected to an external source of AC power. If no external AC power is detected then the control unit automatically switches to the use of battery power if available. The control unit is further configured to automatically recharge the battery in one embodiment, if recharging is needed, and if the microwave is connected to the source of external AC power. The AC detection circuit can also detect whether the input voltage is 110/120 VAC (United States) or 230/240 VAC (Europe) and regulate the voltage as needed so as to be able to use either voltage automatically.

Sixth, in one embodiment, the door or lid to the microwave oven is hinged to open and close. The hinge is provided in one implementation along a surface or side of the oven that opposes the surface or side upon which the user interface is disposed. This configuration allows the user to view the user interface in either orientation, to swing the lid up and open for food item loading and removal when the oven is in the x-y horizontal orientation, and to swing the lid sideways out and open when the microwave is in the z-direction orientation for food item loading and removal. The user interface will thus appear to the right or left side of the microwaveable space when the microwave is in the z-direction orientation and below the microwaveable space when the microwave is in the x-y landscape orientation.

Seventh, it is contemplated that the microwave will operate efficiently and that the major electronic components, such as the transformer and magnetron, may be downsized due to the compact size of the oven. Less heat will be generated accordingly, such that a cooling fan may not be needed, although one could be provided if needed. To this end, and because one primary use for the microwave is to heat precooked food and to not need excessive run times, it is contemplated to limit an overall use or duty cycle, e.g., to X minutes running per hour or X percent of a certain duration. Alternatively or additionally, the microwave oven can have a limited cooking time, e.g., five minutes, to prevent the user from mistakenly entering and executing a large cooking time, e.g., fifty minutes. Generating less heat also makes the microwave safer, e.g., less prone to starting a fire. This may be especially important for a workplace environment.

The overall duty cycle can be limited by a present time (minutes per hour or percentage of time) as discussed above or be limited by an allowable amount of heat that is generated by the microwave oven of the present disclosure. Certain components, such as the magnetron, produce heat and can be damaged by excessive heat. It is accordingly contemplated to place one or more temperature sensor (e.g., a thermistor or thermocouple) on or near one or more of the heat generating components of the microwave oven. For example, a single temperature sensor could be placed on the magnetron, multiple temperature sensors could be placed on the magnetron (for redundancy and/or in case one of the sensors malfunctions), a first sensor could be placed on the magnetron while a second sensor is located in the air or on a wall adjacent the magnetron, or multiple sensors could be located adjacent to the magnetron (air or wall, for redundancy and/or in case one of the sensors malfunctions).

The temperature sensor(s) outputs to a control unit of the microwave oven that can include one or more processor and memory. The control unit compares the temperature sensor output signal (or the average or some other mathematical combination of multiple temperature output signals) to a threshold temperature level that is set for the component, e.g., magnetron, or for the microwave oven overall. As long as the measured signal or combination of measured signals is below (or at or below) the threshold temperature, the microwave may be operated. If the measured signal or combination of measured signals reaches (or exceeds) the threshold temperature, the control unit prevents the microwave oven from heating or cooling food. The control unit can send a message to the user interface display, e.g., "oven overheated, please wait". Then when the measured temperature signal or combination of measured signals fall(s) below the threshold, or a certain number of degrees or percentage below the threshold, or for a certain amount of time below the threshold temperature level, the control unit can send an appropriate follow-up message to the display, e.g., "oven ready", after which the microwave oven can be operated to heat and/or cook food items. In this manner, the microwave can be used until an excessive temperature level (for a component and/or for the microwave generally) is drawing near.

The temperature threshold can be a set temperature. Alternatively, the temperature threshold is a threshold change in temperature. For example, the microwave oven could be shut down if a sensed temperature(s) change exceed(s) $\Delta X$ degrees F. or $\Delta Y$ degrees C. Such a threshold allows the sensor(s) to not have to sense the exact temperature, e.g., to be out of calibration, and still operate with precision assuming that a sensor out of calibration still measures temperature changes efficiently. In many cases, the microwave oven is used indoors where the temperature is regulated, e.g., to 70 degrees F. (21 degrees C.). The threshold temperature change can then be determined by assuming that the beginning microwave temperature is such a temperature or within a range of such temperature. Especially in the case in which the microwave oven is used outdoors, and possibly battery operated, the microwave oven may be cooled or heated significantly by the ambient temperatures. It is accordingly contemplated to employ a hybrid algorithm in which (i) the temperature change or delta threshold is used if the sensed temperature is within a "standard indoor" range, and (ii) the absolute or set temperature threshold is used if the sensed temperature is outside the "standard indoor" range.

Eighth, it is also contemplated that a food item turntable is not needed or provided, further reducing weight, heat and cost. A turntable could alternatively be provided however.

Ninth, certain microwave ovens run a fan blade in front of the magnetron to fragment the outputted microwaves to improve cooking evenness. It is believed that this fan will also not be needed. To increase efficiency, it is contemplated to provide obstructions between the magnetron and the microwaveable space, e.g., within a faraday cage, to improve cooking evenness. The obstructions can be metallic, metal coated or made of or coated with a microwave reflective material. The obstructions, e.g., flat members or rods, solid or perforated, act as static microwave mixers or fragmenters to help evenly distribute the microwaves into the microwaveable space and eliminate or reduce cool spots. The obstructions can be replaced with a perforated sheet, e.g., a perforated metal sheet, a perforated reflective material sheet, or a perforated sheet coated with metal or reflective material. If helpful, the inside of an enclosure defining the microwavable area, if different from the faraday cage, can be made of or coated with a microwave reflective material. Orienting the broad side of the food item towards the magnetron, as is done in both the x-y horizontal and z-direction orientations, also helps to evenly heat the food item.

Tenth (and again none of these features has to, but can be, provided with any of the other features), a food item carrying, microwaveable, odor-absorbing pouch is provided. The pouch in one embodiment is sized to just fit within the microwaveable space and can include, e.g., a living-hinged lid that is releasably closed via hook and pile connection. The pouch can include a nylon exterior and be filled with an odor-absorbing material, such as an activated carbon powder, carbon-filled sponge or carbon-filled fiber. The pouch absorbs odors generated by the heated or cooked food, which may be especially desirable in a workplace environment. Alternatively or additionally, the pouch exterior can be laminated with a perforated microwave reflective film to help to evenly heat or cook food within the pouch. Or, the pouch exterior can hold a perforated microwave reflective material to help to evenly heat or cook food within the pouch.

It is accordingly one advantage of the present disclosure to provide an improved microwave oven.

It is another advantage of the present disclosure to provide a relatively compact microwave oven.

It is a further advantage of the present disclosure to provide a relatively portable microwave oven.

It is still another advantage of the present disclosure to provide a relatively light weight microwave oven.

It is still a further advantage of the present disclosure to provide a microwave oven that generates relatively little heat.

It is yet another advantage of the present disclosure to provide a microwave oven that can be placed in different orientations to receive food items of varying sizes and shapes while allowing the microwave to remain relatively compact.

Moreover, it is an advantage of the present disclosure to provide a microwave oven that allows for efficient microwave space usage and for the food items to be loaded in their intended orientations.

It is yet a further advantage of the present disclosure to provide a microwave oven that can display text right-side-up regardless of which orientation of multiple orientations that the microwave is placed.

Yet another advantage of the present disclosure is to provide a microwave oven that can statically mix or fragment the generated microwaves to help to evenly heat food items.

Additional features and advantages are described herein, and will be apparent from the following Detailed Description and the figures.

DETAILED DESCRIPTION

Control Unit

Figure 1:
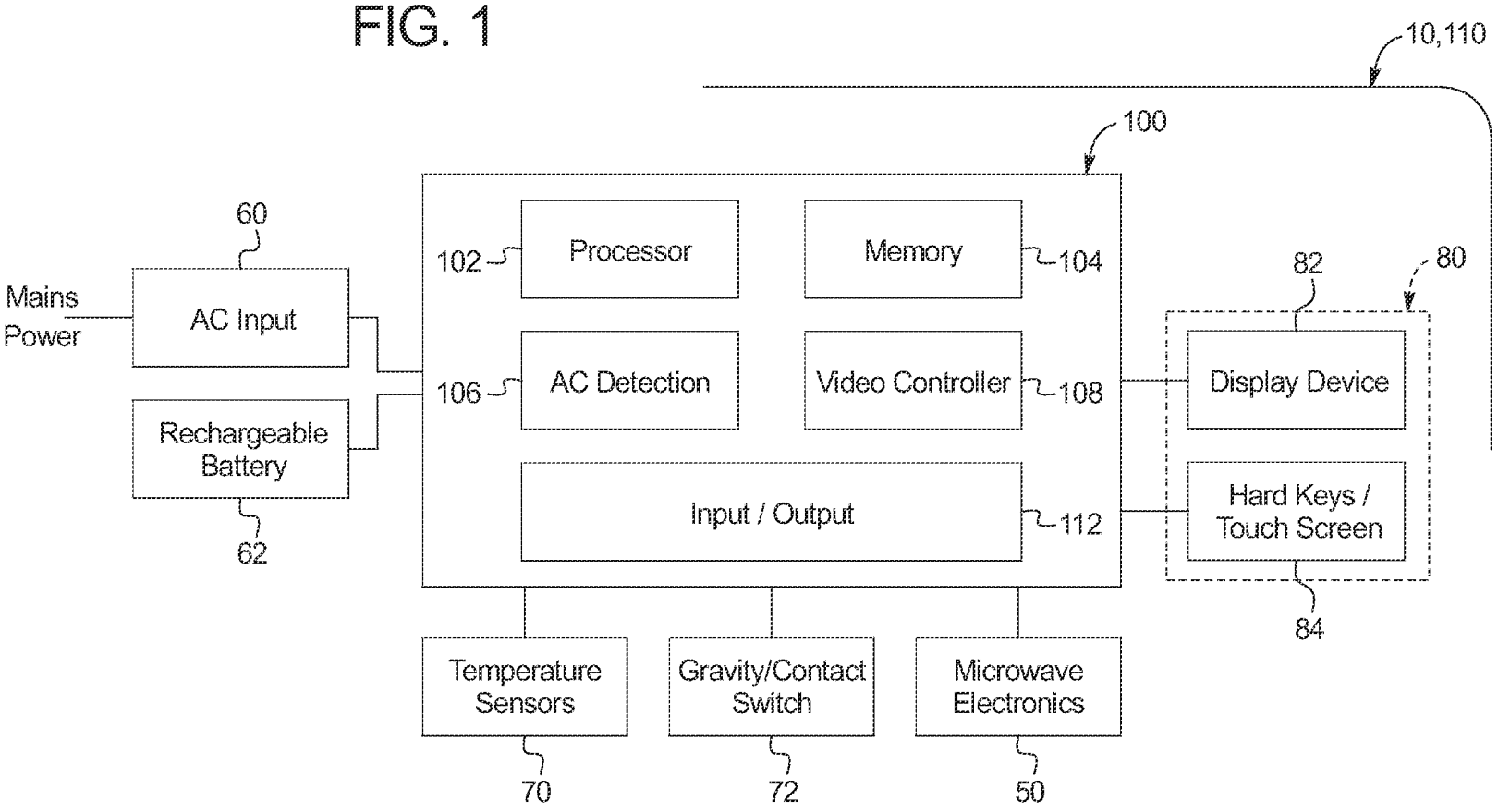
FIG. 1 is a schematic block diagram of one embodiment of a control unit for use with any of the microwave ovens of the present disclosure.

Referring now to the drawings and in particular to FIG. 1, a schematic representation of microwave ovens 10 and 110 is illustrated. Microwave ovens 10 and 110 are each provided with a control unit, such as control unit 100. Control unit 100 in one embodiment includes at least one processor 102 and at least one memory device 104. Processor 102 and memory device 104 can be implemented using coded instructions (e.g., computer readable instructions), wherein memory device 104 can be any one or more tangible computer readable medium, such as a flash memory, a read only memory ("ROM"), a random access memory ("RAM"), a cache, and/or or other storage media in which information is stored for any duration (e.g., for extended time periods, permanently, brief instances, for temporarily buffering, and/or for caching of the information). Alternatively, some or all of the example processes of the present disclosure may be implemented using any combination(s) of application specific integrated circuit(s) ("ASIC(s)"), programmable logic device(s) ("PLD(s)"), field programmable logic device(s) ("FPLD(s)"), discrete logic, hardware, firmware, etc. Also, some or all of the example processes of the present disclosure may be implemented manually or as any combination of any of the foregoing techniques, for example, any combination of firmware, software, discrete logic and/or hardware. Further, although the example processes of the present disclosure, e.g., those illustrated in FIGS. 12 and 13, can be described with reference to the flow diagrams, other methods of implementing the processes may be employed. For example, the order of execution of the blocks may be changed, and/or some of the blocks described may be changed, eliminated, sub-divided, or combined. Additionally, any or all of the example processes of the present disclosure may be performed sequentially and/or in parallel by, for example, separate processing threads, processors, devices, discrete logic, circuits, and the like.

Control unit 100 can be implemented using discrete electrical components and/or an integrated circuit ("IC") chip, each of which can be soldered, e.g., wave or reflow soldered, to one or more printed circuit board ("PCB"), which can be a rigid or flexible PCB. Thus along with processor 102 and memory device 104, the one or more PCB can provide, via one or more IC chip and/or discrete electrical component, any one or more of (i) an alternating current ("AC") detection circuit 106, (ii) a video controller or control circuitry 108 and (iii) input/output circuitry 112.

It is contemplated to allow either one or both of microwave ovens 10 and 110 to be powered alternatively by AC power or by rechargeable battery direct current ("DC") power. AC detection circuit 106 is in electrical and/or operable communication with an AC input device 60, such as a socket that receives a plug and cord connected to mains or line AC power. AC input device 60 is alternatively a cord having a distal plug for plugging into a wall socket for receiving mains or line AC power.

AC detection circuit 106 is also in electrical and/or operable communication with a rechargeable battery 62. Rechargeable battery 62 is removable in one embodiment for replacement, if needed, or if the user decides to lessen the weight of microwave oven 10 and/or 110. In an embodiment, AC detection circuit 106 is configured and programmed to receive and cause microwave oven 10, 110 to use AC power if possible. When AC power is received, AC detection circuit 106 is also configured and programmed to charge, e.g., from fully empty or to top off, rechargeable battery 62 automatically. In this manner, microwave oven 10, 110 when powered under normal operating conditions using AC power should typically have a full supply of backup power via rechargeable battery 62.

As discussed in more detail below in FIGS. 2 to 8, microwave electronics 50 include a transformer 52 that produces the voltage needed for magnetron 54, which produces the microwaves for cooking or heating food items. Very generally, in one embodiment high-voltage transformer 52 steps up AC line voltage to a higher AC voltage, which is then changed to an even higher DC voltage. This high voltage DC power is then converted by magnetron 54 to the radio frequency ("RF") energy that heats or cooks the food item. When the user decides to use DC power, rechargeable battery 62 in an embodiment provides the DC power at the voltage used by magnetron 54. In this case, AC detection circuit 106 operates with processor 102, memory device 104 and input/output control circuitry 112 to bypass high-voltage transformer 52 or to use transformer 52 in a particular configuration. Or, if the rechargeable battery 62 provides the DC power at a voltage less than that needed by magnetron 54, AC detection circuit 106 here operates with processor 102, memory device 104 and input/output control circuitry 112 to use a separate DC in/DC out transformer or to use transformer 52 in a particular configuration.

In an embodiment, transformer 52 (and any other electrical component of ovens 10, 110) can accept and operate with either 110/120 VAC power (typical in the United States) or 230/240 VAC power (typical in Europe). Alternatively, AC detection circuit 106 is further configured to detect whether the input voltage is 110/120 VAC or 230/240 VAC and regulate the voltage as needed, so as to be able to accept either voltage automatically. For example, the microwave oven 10, 110 can be configured to run on 110/120 VAC. If AC detection circuit 106 detects 230/240 VAC, the circuitry converts the voltage to 110/120 VAC, which is then used downstream by the remainder of microwave oven 10, 110.

Video controller or control circuitry 108 commands display device 82 of user interface 80 to display information generated by processor 102 and memory device 104. For example, microwave oven 10, 110 as described below can be programmed to have an overall duty cycle that is limited by run time or sensed temperature. If the duty cycle cutoff is reached, processor 102 and memory device 104 command video control circuitry 108 to display a suitable message on display device 82, such as, "oven overused, please wait" or "oven overheated, please wait". When the oven can be used again, processor 102 and memory device 104 command control circuitry 108 to display a suitable response message on display device 82, such as, "oven ready".

Touch screen and/or electromechanical switches (e.g., membrane switches) 84 of user interface 80 operate with input/output control circuitry 112 to enable the user to enter information, which is then manipulated by processor 102 and memory device 104. As discussed in more detail below, the user can enter commands via touch screen and/or electromechanical switches 84, such as start time entry, start clock set, cancel, clear, oven start and oven stop. The user can also enter the time for heating/cooking and clock time via touch screen and/or electromechanical switches 84 via a virtual or hard key numeric keypad.

As further illustrated in FIG. 1, input/output control circuitry 112 also outputs to microwave electronics 50, which can include transformer 52 and magnetron 54. If needed, microwave electronics 50 can also include one or more fan, such as a fan (not illustrated) for cooling magnetron 54 and/or for scattering its outputted microwaves. As discussed in more detail below, in an attempt to eliminate the need for a cooling fan, it is contemplated to limit the overall duty cycle of microwave oven 10, 110. One way to do so is to sense the temperature of a component, e.g., magnetron 54, that is prone to overheating and/or to sense an area of microwave oven 10, 110 located close to such component. To this end, one or more temperature sensor 70, such as a thermistor or thermocouple, can be provided, which outputs to processing 102 and memory 104 via input/output control circuitry 112.

As mentioned above, in one embodiment user interface 80 operates with a touch screen 84. Especially in this case (but a touch screen is not required), one or more gravity or contact switch 72 (both discussed in detail below) may be provided to detect the orientation in which microwave oven 10, 110 has been placed. Gravity or contact switch(es) 72 likewise outputs to processing 102 and memory 104 via input/output control circuitry 112. Processing 102, memory 104 and video controller 108 orient user interface 80 accordingly, as discussed in detail below.

Microwave Oven Operational Orientations

Figure 2:
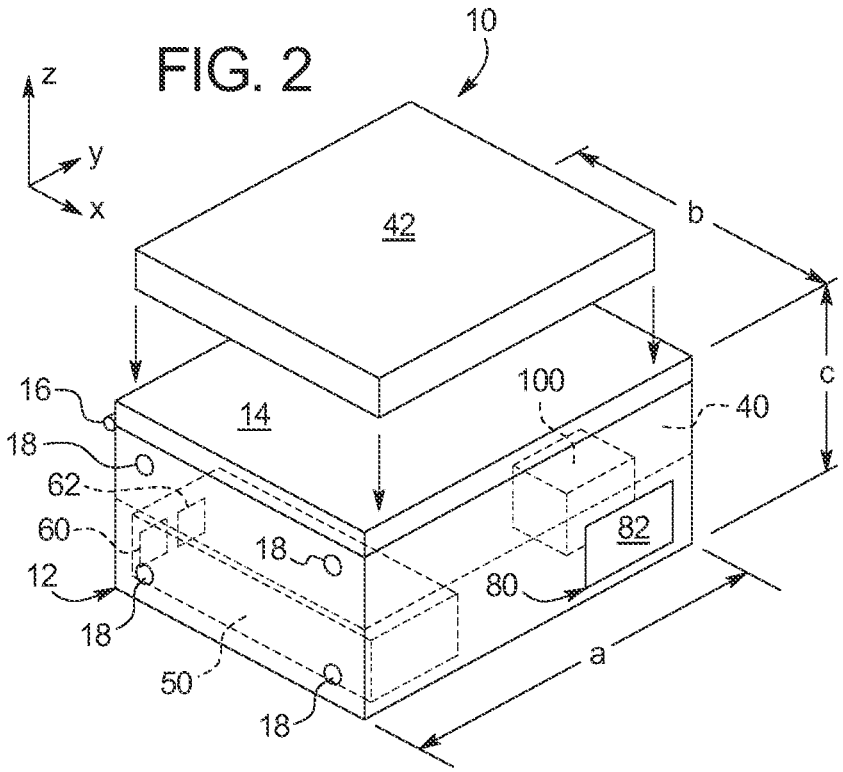
FIG. 2 is a first perspective view of a first housing configuration for a compact microwave oven of the present disclosure.
Figure 3:
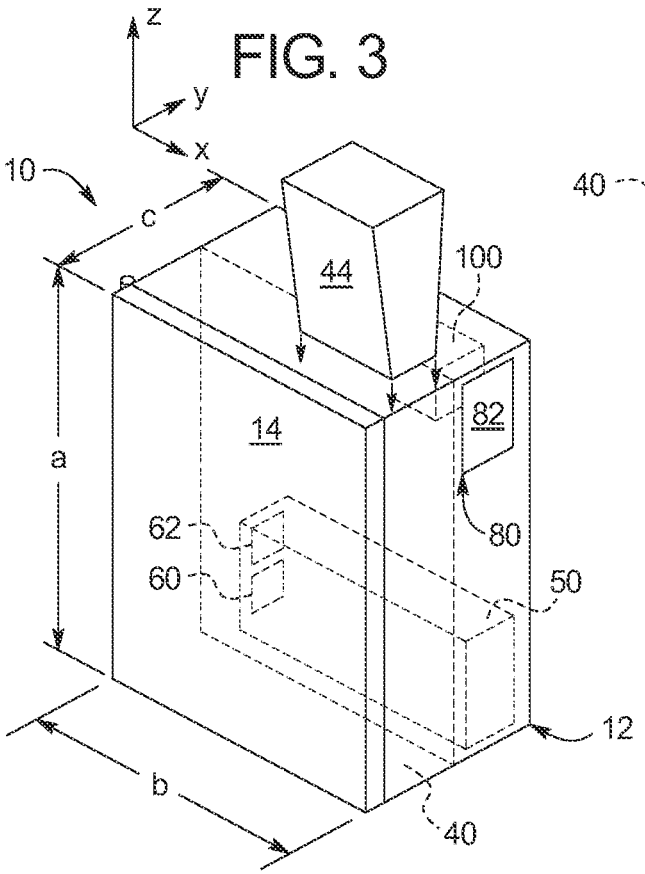
FIG. 3 is a second perspective view of the first housing configuration for a compact microwave oven of the present disclosure.
Figure 4:
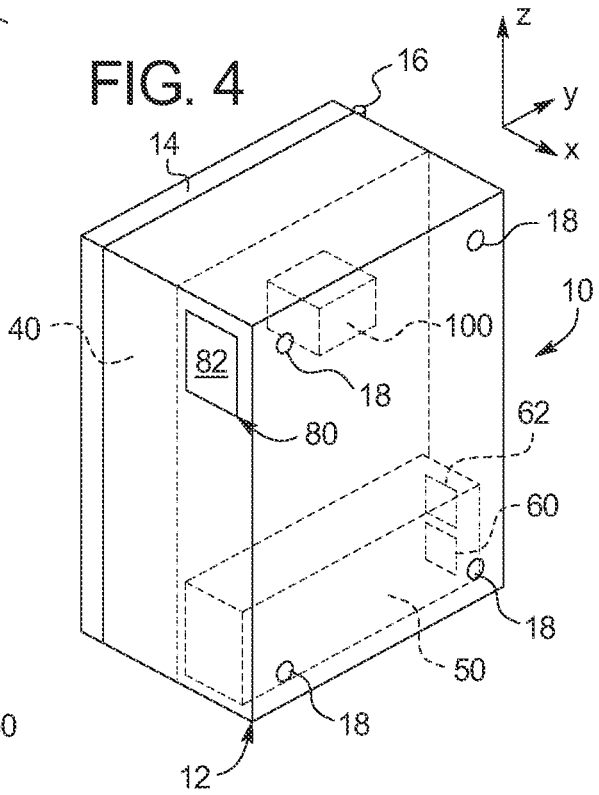
FIG. 4 is a third perspective view of the first housing configuration for a compact microwave oven of the present disclosure.

Referring now to FIGS. 2 to 4, one embodiment of a compact microwave oven of the present disclosure is illustrated by oven 10. To illustrate many of the features of oven 10 an x-y-z coordinate system is provided and is consistent for each of FIGS. 2 to 4. As illustrated, the z-axis is the vertical axis, while the x- and y-axes form a horizontal plane orthogonal to the z-axis. Microwave oven 10 has dimensions a×b×c, where dimension c is smaller than dimensions a or b. Thus it should be appreciated that in one embodiment microwave oven 10 is generally rectangular in shape having two surfaces defined by the dimensions a and b, two surfaces defined by the dimensions a and c, and two surfaces defined by the dimensions b and c.

In FIG. 2, microwave oven 10 is placed in an x-y horizontal orientation, while in FIGS. 3 and 4, microwave oven 10 is placed in a z-direction vertical orientation. The orientations are each labeled based upon the shape of the food item (container) for which the orientation is best able to receive. That is, food item 42 when oriented in its proper position for heating or cooking lies generally in an x-y horizontal plane. Food item 42 could for example be a frozen meal containing multiple compartments filled separately with different types of foods. The x-y horizontal plane is the best plane to receive food item 42 so that the different foods do not run together when heated or melted. Microwave oven 10 is therefore placed in the x-y horizontal orientation of FIG. 2 to heat or cook food item 42, allowing food item 42 to lie in its proper heating or cooking position.

On the other hand, food item 44 when oriented in its proper position for heating or cooking extends furthest in the z-direction. Food item 44 could for example be a cardboard or plastic upright container having a removable lid or openable top. Here, the z-direction plane is the best to receive food item 44, so that the lid or top does not have to be laid on its side, potentially opening, while food item 44 is heated or melted. Microwave oven 10 is therefore placed in the z-direction vertical orientation of FIGS. 3 and 4 to heat or cook food item 42.

It should be appreciated that a microwavable space 40 of oven 10 adapts to the proper orientation of the food item as opposed to having a single orientation that has to be large enough to accept both food items 42 and 44. This allows microwavable space 40 to be smaller while still accommodating a large array of differently shaped food items. And because a larger percentage of the microwavable space 40 is filled on average, usage efficiency is increased.

In the x-y horizontal orientation of FIG. 1, a first surface defined by dimensions a-b serves as the bottom surface, or surface of oven 10 that rests upon a support, such as a desk, drawer, countertop, shelf, credenza, table or the like. In the z-direction orientation of FIGS. 3 and 4, a second surface defined by dimensions b-c serves as the bottom surface or surface of oven 10. Microwave oven 10 can be flipped such that either surface a-b or b-c serves as the bottom surface. Oven 10 functions equally well in either orientation.

The front of microwave oven 10 is the same for both the x-y horizontal and z-direction orientations and resides on one of the a-c surfaces in one embodiment. Accordingly, the back of microwave oven 10 is the same for both the x-y horizontal and z-direction orientations and resides on the other of the a-c surfaces. User interface 80, including display device 82, is placed on the front a-c surface and therefore faces the user in either orientation. In this manner, the user can easily program and view the status of microwave oven 10 regardless of the orientation (FIG. 2 v. FIGS. 3 and 4) in which oven 10 is placed.

Microwave oven 10 includes a housing 12 and a door or lid 14, which is hinged to housing 12 via hinge 16 (or multiple hinges 16). In the illustrated embodiment of FIGS. 2 to 4, hinge 16 is located on the back a-c surface in either orientation in one embodiment. In this manner, door or lid 14 always opens up to the user. In FIG. 2, door or lid 14 pops open from the top of oven 10, creating an opening directly in front of the user through which the user can readily insert food item 42 into microwaveable space 40. In FIGS. 3 and 4, door or lid 14 pops open from the side of oven 10, again creating an opening directly in front of the user through which the user can readily insert food item 44 into microwaveable space 40. In the illustrated embodiment, hinge 16 is accordingly always on the backside of oven 10, out of the way and generally hidden.

In an embodiment, the oven's power components are also located on the back a-c surface in either orientation. For example, AC input 60 (socket or plug) and rechargeable battery 62 are located on the back a-c surface of oven 10. Rechargeable battery 62 is in one embodiment also removable and replaceable into the back surface of oven 10 regardless of the orientation of oven 10. Placing AC input 60 in the back of oven 10 allows the microwave to be turned to either orientation without rerouting the power cord or causing the cord to bind or bow. In the illustrated implementation, AC input 60 remains on the lower half of oven 10 regardless of its orientation, such that the user will likely not even see or feel the cord move, assuming the cord is not overly tensioned to begin with.

As illustrated, it is also contemplated in one embodiment to configure and arrange the heavier microwave electronics 50 (e.g., transformer 52 and magnetron 54), such that the heavier items sit at the bottom of oven 10 regardless of its operational orientation. Placing the heavier items at the bottom of oven 10 helps its stability and reluctance to slide or tip. Regarding tipping, it is also expressly contemplated that if dimensions a and b are each larger than c, as is the case with oven 10 in FIGS. 2 to 4, that user interface 80 is not placed on either of the a-b surfaces and is instead placed on an a-c or b-c surface. In the x-y horizontal orientation of FIG. 2, it is difficult to tip oven 10. In the z-direction vertical orientation of FIGS. 3 and 4, however, tipping becomes more problematic. The problem is reduced by not allowing the short dimension (e.g., the c dimension) to be the oven's depth dimension. In the illustrated embodiment, the longer b dimension is the depth dimension.

In the illustrated embodiment (best seen in FIGS. 2 and 4), both the a-b (FIG. 2) and b-c (FIGS. 3 and 4) bottom surfaces are provided with frictional, impact-absorbing, e.g., rubber, feet 18. Each surface includes four feet 18, however, more or less feet may be provided per surface as desired. Feet 18 provide a cushioned, dampened interface between housing 12 and the structure upon which microwave oven 10 rests. In the z-direction vertical orientation of FIGS. 3 and 4, feet 18 also serve to lift door or lid 14 off of the supporting structure to allow the door or lid 14 to swing open and closed freely. Alternatively, if no feet 18 are provided, lid 14 can be sized somewhat smaller than housing 12 to likewise allow the door or lid 14 to swing open and closed freely. Feet 18 also serve to buffer housing 12 should oven 10 tip over. Further, the provision of feet 18 on two surfaces of housing 12 provides a visual queue to a new user that microwave oven 10 can be placed and operated in multiple orientations.

Figure 5:
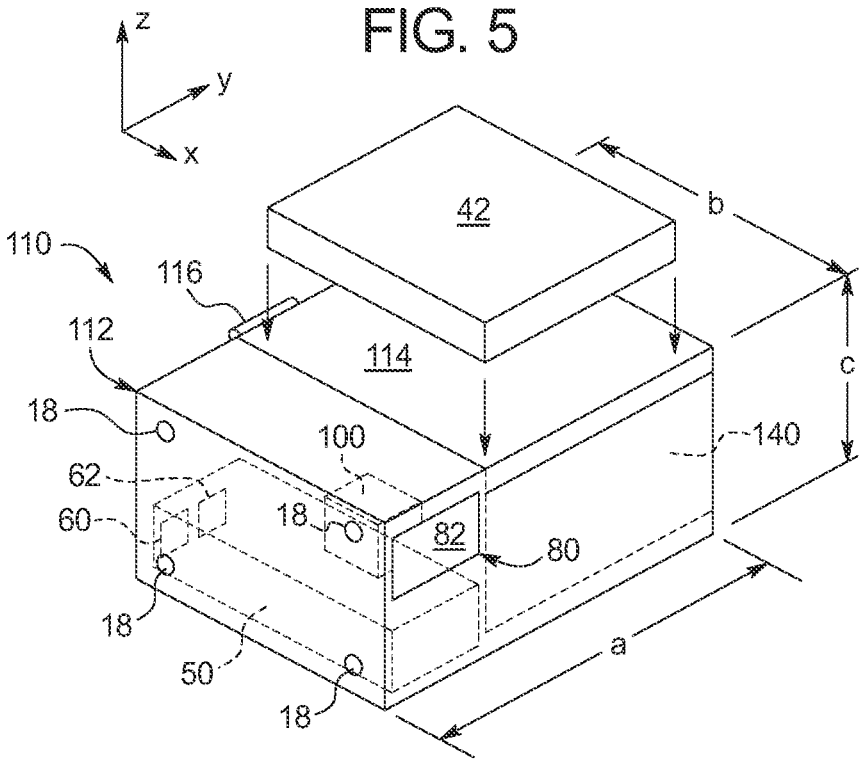
FIG. 5 is a first perspective view of a second housing configuration for a compact microwave oven of the present disclosure.
Figure 6:
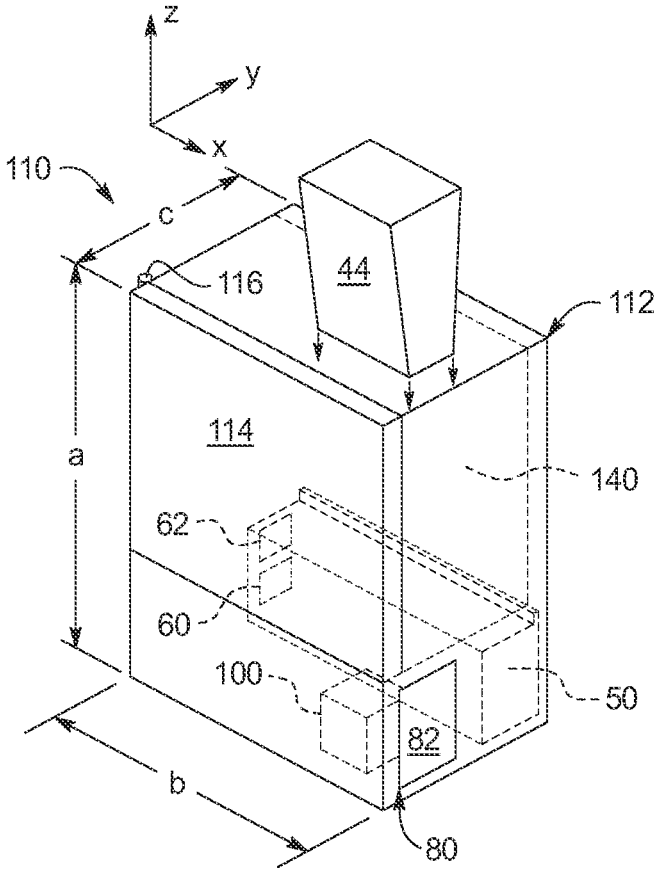
FIG. 6 is a second perspective view of the second housing configuration for a compact microwave oven of the present disclosure.

Referring now to FIGS. 5 and 6, a second embodiment of a compact microwave oven of the present disclosure is illustrated by oven 110. An x-y-z coordinate system is illustrated again and is again consistent for each of FIGS. 5 and 6. Microwave oven 110 has roughly the same shape as oven 10 and again includes dimensions a×b×c, where dimension c is smaller than dimensions a or b. It should be appreciated that either or both of microwave ovens 10 or 110 can be longer, squatter, and/or have non-flat or curved surfaces.

Microwave oven 110, like oven 10, has dual operating orientations to accept x-y horizontal food item 42 and z-direction vertical food item 44 as described above. Microwave oven 110, like oven 10, includes an AC input 60, a rechargeable battery 62, a user interface 80 including a display device 82, microwave electronics 50, each operating with a control unit 100. Either one or both of bottom surfaces a-b (FIG. 5) and b-c (FIG. 6) can again be provided with frictional, impact-absorbing, e.g., rubber, feet 18.

Microwave oven 110 has a differently configured housing 112 and door 114, which is again hinged to housing 112 via one or more hinge 116 in the illustrated embodiment. The differences in configurations between housings 12 and 112 will be discussed. It should be appreciated however that microwave oven 110 and housing 112 are constructed so as to share each of the advantages discussed above for oven 10 and housing 12, such as, the advantageous location of user interface 80, the advantageous operation of door or lid 114, the advantageous location of heavier components 50, the advantageous location of power components 60 and 62, the prevention of sliding/tipping, and the benefits of feet 18.

The primary difference between oven 10 and oven 110 is the configuration of microwaveable space 140 of oven 110 versus the microwaveable space 40 of oven 10. With oven 10, microwaveable space 40 extends all the way along dimensions a and b and only partway, e.g., approximately halfway, along dimension c. With oven 110, microwaveable space 140 extends instead all the way along dimension b and c and only part way along dimension a. The different configurations of microwaveable spaces 40 and 140 may, but does not have to, lead to different locations and orientations for one or more of the microwave components 50, such as magnetron 54.

With oven 110, user interface 80 including display device 82 resides towards the bottom of the microwave in the z-direction orientation of FIG. 6. With oven 10, user interface 80 is located instead near the top of housing 12 in the z-direction orientation of FIGS. 3 and 4. The components selected for the microwave electronics 50, controller 100 and the user interface 80 may lend themselves towards one of the configurations of housing 12 or 112 of respective microwave ovens 10 and 110. In either case, however, ovens 10 and 110 remain compact and accept food items 42 and 44 in their proper and desired positions for efficient microwave heating or cooking.

Microwave Oven Component Layout

Figure 7:
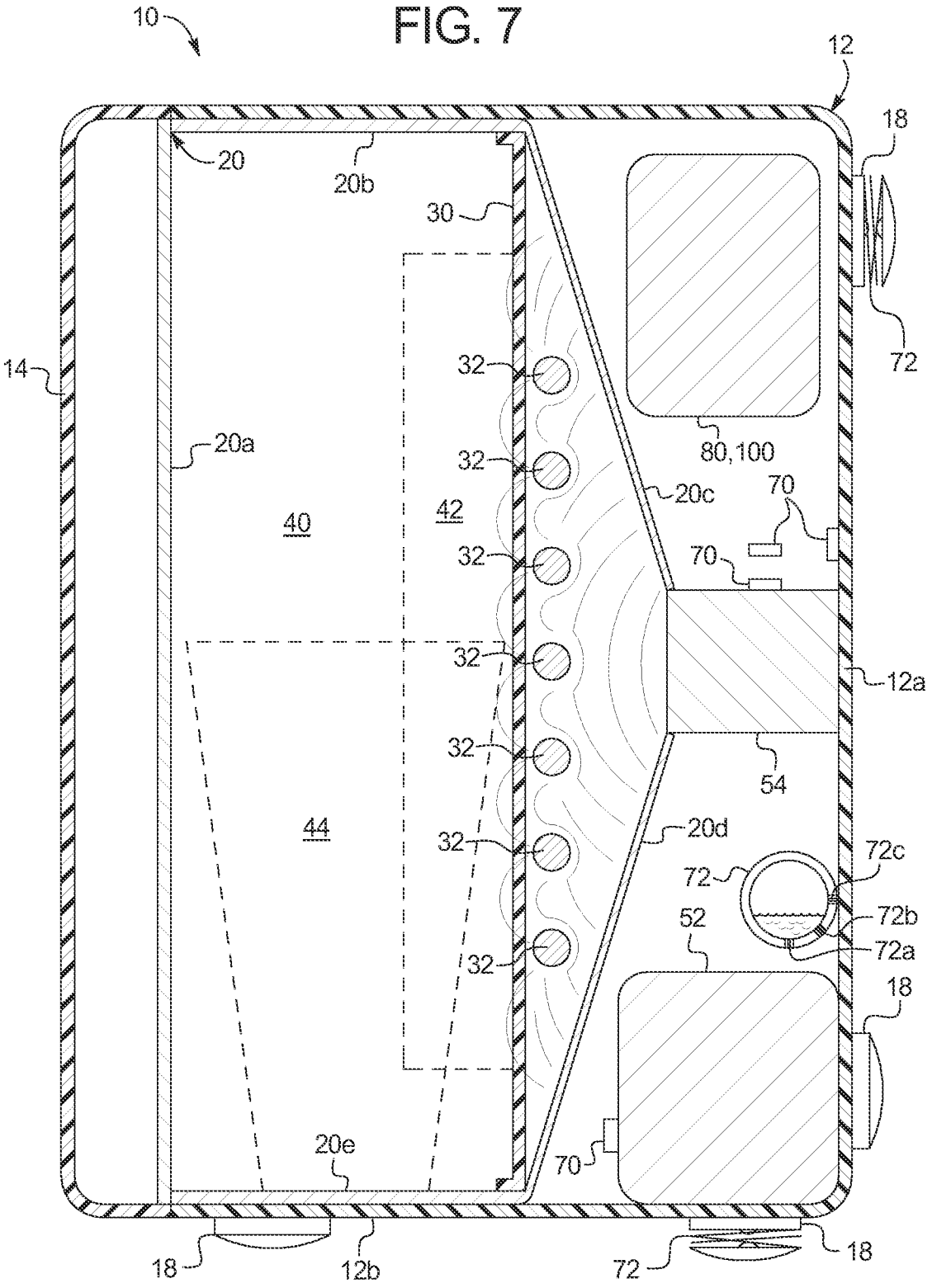
FIG. 7 is a sectioned elevation view illustrating one possibility for locating components within the first housing configuration illustrated in FIGS. 2 to 4.
Figure 8:
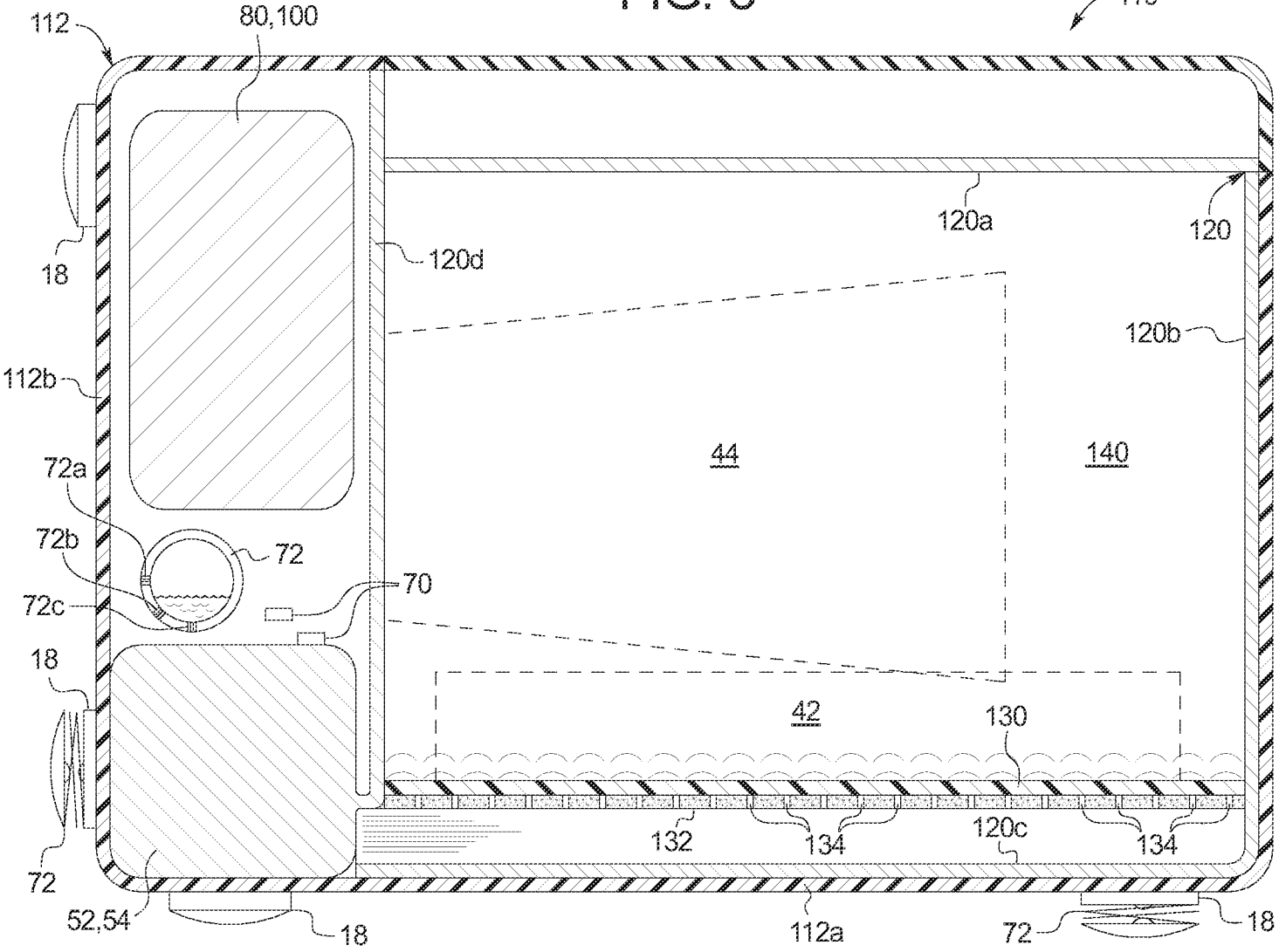
FIG. 8 is a sectioned elevation view illustrating one possibility for locating components within the second housing configuration illustrated in FIGS. 5 and 6.

Referring now to FIGS. 7 and 8, embodiments for the component layout of microwave ovens 10 and 110 are illustrated respectively. FIG. 7 illustrates an embodiment of microwave oven 10 from the front of the oven. Microwave oven 10 includes housing 12, which is connected to door or lid 14 via hinge or hinges 16 (not viewable in FIG. 7 because they are located at the back of housing 12). Housing 12 and door 14 are provided with a spring-loaded latch and mating aperture that are activated by a spring-loaded button (not illustrated) in one embodiment to enable the user to open door or lid 14. Door 14 then latches to housing 12 when pressed closed by the user.

Heavier microwave electronics 50, such as a transformer 52, are located at the bottom and right side of housing 12 in the illustrated embodiment. Magnetron 54, which receives operating power from transformer 52, is located above transformer 52 in the approximate middle of dimension a, which is the approximate z-direction middle of microwave-able space 40. Magnetron 54 can also be located at the middle, or approximate middle, of dimension b such that magnetron 54 is centered, or approximately centered, in the x-y horizontal orientation plane. In the illustrated embodiment, control unit 100 and user interface 80 are located away from transformer 52 and can be electrically isolated from transformer 52 and/or magnetron 54 if need be. That is, lower voltage level components can be electrically isolated from the larger voltages of transformer 52 and/or magnetron 54 if need be to prevent arcing and/or signal disruption.

Housing 12 houses a gravity switch or mercury switch 72 in the illustrated embodiment. Gravity switch is used to detect the orientation of housing 12 and microwave oven 10. The detected orientation can then be used to orient the display of display device 82 as discussed below in connection with FIGS. 9 and 10. In the illustrated embodiment, mercury switch 72 includes three contacts 72*a* to 72*c* and enough mercury (or other conductive fluid) to make electrical contact with contacts 72*a* and 72*b* if oven 10 is in the z-direction vertical orientation shown in FIG. 7 or with contacts 72*b* and 72*c* if microwave 10 is in the x-y horizontal orientation of FIG. 2. The different contact closures enable different paths of input/output circuitry 112 to flow electrical current, allowing the orientation of oven 10 to be electrically sensed and a signal indicative of the sensed orientation to be sent via processing 102 and memory 104 to video controller 108 to control user interface 80 and display device 82 accordingly.

In the place of, or in addition to gravity switch 72, one or more spring-loaded contact switch 72 can be provided, for example, with one or more frictional, impact-absorbing, e.g., rubber, feet 18. In the illustrated embodiment one foot 18 on each of the a-b bottom surface 12*a* and the b-c bottom surface 12*b* of microwave oven 10 is provided with a spring-loaded switch 72. In each case, foot 18 is split and a spring is inserted between the foot portions. When oven 10 is oriented so that the contact foot 18 becomes compressed between the microwave and the supporting structure, the spring compresses and a contact closure is made. When oven 10 is lifted from that orientation, the spring bias opens the spring and breaks the contact closure of switch 72.

There can be one or more contact foot on one or both of the a-b bottom surface 12*a* and *b-c* bottom surface 12*b* illustrated in FIG. 7. In one example, control unit 10 is programmed to default to a user interface display for the x-y horizontal orientation (FIG. 2) when no input is sensed. Here, the a-b bottom surface 12*a* therefore needs no spring-loaded contact switch 72. The b-c bottom surface 12*b* can be provided with a single contact foot 18, which if closed signals via control unit 100 that oven 10 is instead oriented in the z-direction vertical orientation of FIG. 7 and that the display of information for user interface 80 should be switched accordingly. In the default example, multiple contact feet 18 can be provided on the b-c bottom surface 12*b* for redundancy and/or in case one of the spring-loaded contact switches 72 fails.

Alternatively, each of the a-b and b-c bottom surfaces 12*a*, 12*b* includes a spring-loaded contact switch 72 provided in conjunction with a foot 18. Here, control unit is programmed such that the user interface 80 and its display device 82 are inactive unless a switch 72 is closed on one of the a-b and b-c bottom surfaces 12*a*, 12*b*. If a switch 72 closes on the a-b bottom surface 12*a*, a particular path of input/output circuitry 112 is allowed to flow electrical current, allowing the x-y horizontal orientation to be electrically sensed and a signal indicative of the present orientation to be sent via processing 102 and memory 104 to video controller 108 to control user interface 80 and display device 82 appropriately for the x-y horizontal orientation of FIG. 2. If instead a switch 72 closes on the b-c bottom surface 12*b*, a different path of input/output circuitry 112 is allowed to flow electrical current, allowing the z-direction vertical orientation to be electrically sensed and a signal indicative of the present orientation to be sent via processing 102 and memory 104 to video controller 108 to control user interface 80 and display device 82 appropriately for the z-direction vertical orientation of FIGS. 3, 4 and 7. Again, either or both of the a-b and b-c bottom surfaces 12*a*, 12*b* can include multiple contact feet 18 for redundancy and/or in case one of the spring-loaded contact switches 72 fails.

FIG. 7 also illustrates temperature sensors 70, such as thermistors or thermocouples, which are placed on a desired microwave component 50, on a wall near the desired component 50, or in the air adjacent to the desired component 50, to measure one or more pertinent temperature. In the illustrated embodiment, temperature sensors 70 are placed on or about transformer 52 and magnetron 54. Temperature signals from temperature sensors 70 can be analyzed individually and/or collectively to arrive at a determination of whether it is safe to allow oven 10 to begin or continue heating or cooking a food item. Sensors 70 output to input/output circuitry 112 of control unit 100 as illustrated in FIG. 1. Input/output circuitry 112 communicates with processing 102 and memory 104, which are programmed to analyze the signals. Processing 102 and memory 104 output commands to accordingly allow or disallow the running of the microwave electronics 50 and to have appropriate messages displayed on display device 82.

As further illustrated in FIG. 7, magnetron 54 emits microwaves into a sealed metal faraday cage 20, which is made up of metal (or metal coated plastic) walls 20*a*, 20*b*, 20*c*, 20*d* and 20*e*. In an embodiment, walls 20*b*, 20*c*, 20*d* and 20*e* can be stamped from a single sheet of metal, or be two or more separate walls, and be welded, press-fitted and/or bolted together if needed. Cage wall 20*a* is the inner wall of door or lid 14 in one embodiment, which is pressed against walls 20*b* and 20*e* when door 14 is closed to form a metal enclosure. The metal enclosure is then fitted to the output of magnetron 54, forming faraday cage 20. A splash, e.g., plastic, wall 30 is press-fitted, bolted and/or adhered to the faraday cage as illustrated to form microwaveable space 40 along with cage walls 20*a*, 20*b* and 20*e*.

Splash wall 30 also forms a space with cage walls 20*c* and 20*d*, which resides just outside of the output of magnetron 54. A plurality of static microwave obstructions 32 are located inside the space defined by splash wall 30 and cage walls 20*c* and 20*d*. Obstructions 32 can extend outside of cage walls 20*c* and 20*d* if desired. Microwave obstructions 32 can be metal and/or of or coated with a microwave reflective material. The reflective coating can be a metal foil, sputtered layer, or metallic paint layer. Obstructions 32 can be in cross-section round, rectangular, polygonal, jagged, smooth, and/or have another shape or shape attribute that is adept at reflecting microwaves. Longitudinally, obstructions 32 can be continuous and/or segmented, straight, bent and/or curved. Obstructions 32 are sized and fixed far enough away from any of the metal walls of faraday cage so that arching is prevented.

It is also contemplated to use a reflective or even semi-reflective material for obstructions 32 that will not arch with the faraday cage walls 20*c* and 20*d* even if spaced closely to the walls. For example, the material for obstructions 32 can be a conductive particle filled polymer or rubber. The material can alternatively be a conductive mesh or fabric. The conductive components of these materials reflect microwaves outputted from magnetron 54 but are in one embodiment not collectively conductive enough to promote arching with faraday cage walls 20*c* and 20*d*.

In any case, obstructions 32 as illustrated in FIG. 7 disrupt the microwave pattern emanating from magnetron 54. The disrupted wave pattern is less prone to producing "cold spots", common to known microwave ovens that lead to unevenly heated food. It should also be appreciated from FIG. 7 that both the x-y horizontal food item 42 and the z-direction food item 44 are placed so that their broadest surfaces face the output of magnetron 54. Such placement maximizes the surface area of the food, which is orthogonal to the direction of the output of magnetron 54, further improving heating or cooking efficiency.

Referring now to FIG. 8, an embodiment of alternative microwave oven 110 is illustrated. Microwave oven 110 includes housing 112 that is connected to door or lid 114 via a hinge or hinges 116 (not viewable in FIG. 8 because the hinges are located at the back of housing 112). Housing 112 and door 114 are also provided with a spring-loaded button and latch and mating aperture as described above for oven 10.

Heavier microwave electronics 50, such as a transformer 52, are located at the bottom and left side of housing 112 in the illustrated embodiment. Magnetron 54, which receives operating power from transformer 52, is located in front of or behind transformer 52 and in the approximate middle of dimension b, or the approximate middle of microwaveable space 140 along dimension b. In the illustrated embodiment, control unit 100 and user interface 80 are located away from transformer 52 and magnetron 54 and can again be electrically isolated from same if need be.

As illustrated in FIG. 8, microwave oven 110 can also include a gravity switch or mercury switch 72 and/or one or more spring-loaded contact switch 72 (e.g., integrated into feet 18), which operate with control unit 100 to detect whether housing 112 of microwave oven 110 has been placed on its a-b surface 112*a* or its b-c surface 112*b* for operation. As discussed above, control unit 100 orients the display device 82 and possibly the inputs and controls of user interface 80 appropriately in response to the sensed orientation via the gravity and/or contact switches. FIG. 8 further illustrates that housing 112 can include one or more temperature sensor 70, placed in any of the configurations discussed above for oven 10, which can be used to detect when one or more component of microwave oven 110 has exceeded or is close to exceeding a safe operating limit. One embodiment for using temperature sensor 70 to control oven duty cycle for ovens 10 and 110 is discussed below in connection with FIG. 13. Any and all embodiments and alternatives discussed above for the structure and use of gravity switches 72, contact switches 72 and temperature sensors 70 are equally applicable to oven 110.

FIG. 8 also illustrates that magnetron 54 emits microwaves into a sealed metal faraday cage 120, which is made up of metal (or metal coated plastic) walls 120*a*, 120*b*, 120*c* and 120*d*. Walls 120*b* to 120*d* can be welded, press-fitted and/or bolted together to form a metal enclosure. The metal enclosure is then fitted to the output of magnetron 54, forming faraday cage 120. Cage wall 120*a* is the inner wall of door or lid 114 in one embodiment. A splash, e.g., plastic, wall 130 is press-fitted, bolted and/or adhered to the faraday cage as illustrated to form microwaveable space 140 along with cage walls 120*a*, 120*b* and 120*d*.

As with oven 10, splash wall 130 of oven 110 forms a space with cage wall 120*c*, which resides just outside of the output of magnetron 54. A plurality of static microwave obstructions 32, including any of the embodiments and alternatives for obstructions 32 discussed above, could be located inside the space defined by splash wall 30 and cage wall 120*c*. Oven 110 illustrates an alternative embodiment, however, in which a perforated or porous microwave signal blocking wall or layer 132 is provided instead. Signal blocking wall or layer 132 can be made of any of the materials discussed above for obstructions 32, for example, of metal or of a conductively impregnated polymer or a conductive fabric. Signal blocking wall or layer 132 can alternatively be a conductive paint or ink that is stencil painted, e.g., sprayed over a stencil onto, splash wall 130. Signal blocking wall or coating 132 can further alternatively be a conductive paste that is printed, e.g., screen printed, onto splash wall 130. Thus, signal blocking wall 132 does not have to be its own free-standing wall and can instead be a conductive or semi-conductive layer or coating applied to and supported by splash wall 130. The overall conductivity of signal blocking wall or layer 132 is set so that arching with conductive walls 120*b*, 120*c* and 120*d* will not occur. To this end, while signal blocking wall or coating 132 is shown extending all the way along splash wall 130, signal blocking wall or coating 132 could instead be located only in the center of splash wall 130 or otherwise not extend all the way to the edges of splash wall 130, so that a suitable distance between the signal blocking wall or coating and conductive walls 120*b* and 120*d* is provided.

Signal blocking wall or layer 132 can be formed to have apertures or openings 134 for allowing microwaves to exit into microwaveable space 140. While multiple small openings 134 are illustrated, openings 134 could instead be a lesser number of larger openings. Signal blocking wall or layer 132 disrupts the microwave pattern emanating from magnetron 54 and forces the disrupted microwaves through apertures or openings 134. The disrupted wave pattern is again less prone to producing "cold spots", common to known microwave ovens, which lead to unevenly heated food. It should again be appreciated from FIG. 8 that both the x-y horizontal food item 42 and the z-direction food item 44 are placed so that their broadest surfaces face the output of magnetron 54. Such placement maximizes the surface area of the food that is orthogonal to the direction of the microwaves through apertures 134, further improving heating or cooking efficiency.

In the illustrated embodiment of FIG. 8, magnetron 54 is oriented differently than with oven 10 of FIG. 7. Here, magnetron 54 outputs microwaves tangentially to food items 42 and 44, signal blocking wall 132 and openings 154, into a plenum formed by splash wall 130, signal blocking wall or layer 132 and conductive wall 120*c*. The microwaves exit through openings 134 that are, in general, disposed perpendicularly with respect to the direction in which the outlet of magnetron 54 is disposed. The tangential microwave emission of oven 110 of FIG. 8 can be used also with oven 10 of FIG. 7, including obstructions 32 and splash wall 30 of oven 10. Likewise, the microwave emission directly towards the food items 42 and 44 of oven 10 of FIG. 7 can be used also with oven 110 of FIG. 8, including its splash wall 130 and signal blocking wall or layer 132. Still further, obstructions 32 can be used in place of signal blocking wall or layer 132 with oven 110 of FIG. 8. Likewise, signal blocking wall or layer 132 can be used in place of obstructions 32 with oven 10 of FIG. 7.

User Interfaces

Figure 9:
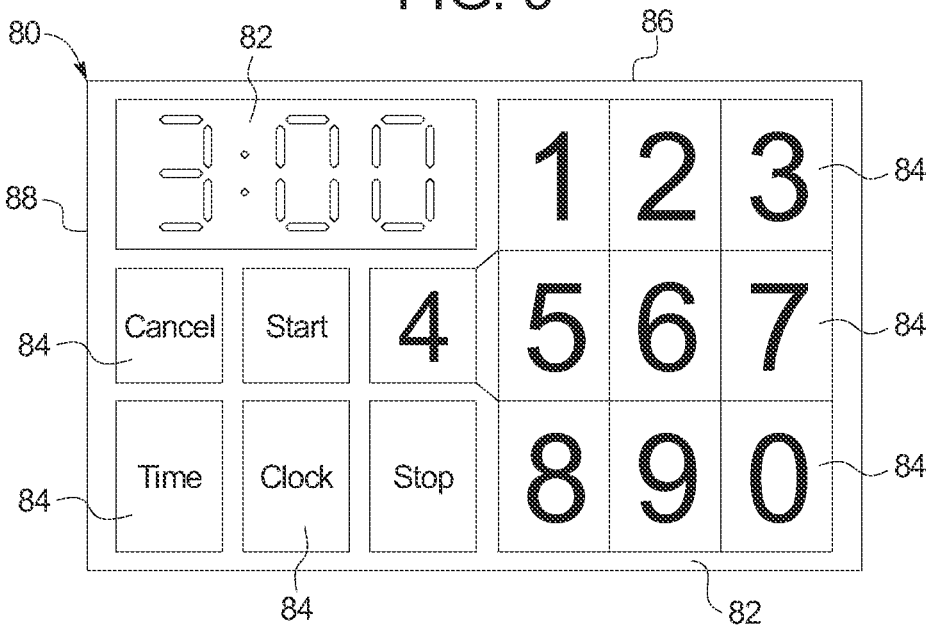
FIGS. 9 and 10 are elevation views of one embodiment of a rotatable user interface for use with any of the microwave ovens of the present disclosure.
Figure 10:
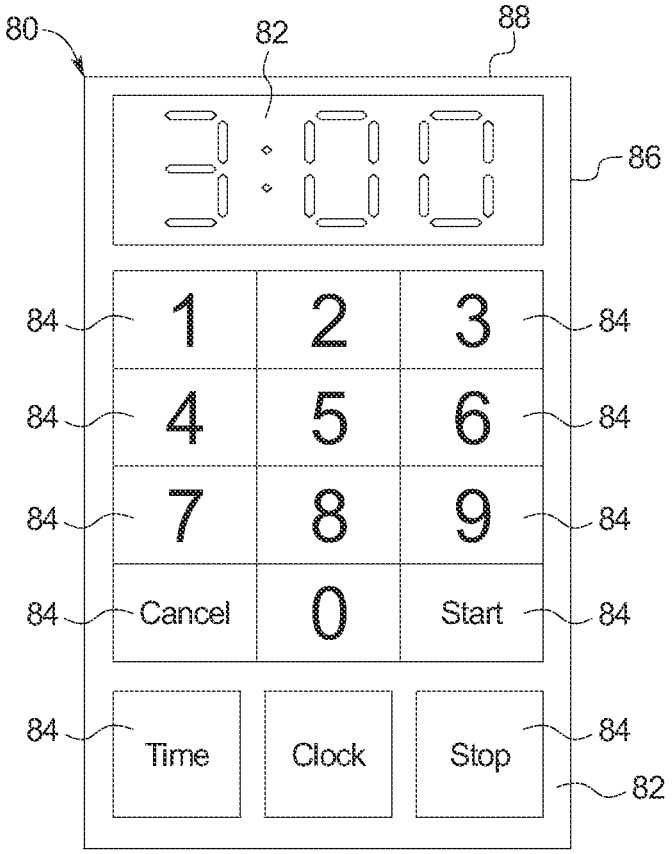

Referring now to FIGS. 9 and 10, one embodiment of user interface 80 is illustrated. As discussed above, user interface 80 including display device 82 is controlled by control unit 100, including processing 102, memory 104 and video controller 108. user interface 80 in FIGS. 9 and 10 employs a touch screen 84 that is oriented depending upon a signal from gravity and/or contact switches 72, the structure and operation of which have been described in detail above. Thus each of the digits "0" to "9" of the keypad of user interface 80, the "Cancel" button, the "Start" button, the "Time" button, the "Clock" button, and the "Stop" button are touch screen inputs. Touch screen 84 allows the display of any one or more of display device 82, the digits "0" to "9", the "Cancel" button, the "Start" button, the "Time" button, the "Clock" button, and the "Stop" button to be moved and/or rotated as desired with respect to the boundaries 86 and 88 of user interface 80.

FIG. 9 illustrates user interface 80 as it is displayed for the x-y orientation of oven 10 in FIG. 2 and oven 110 in FIG. 5. Display device 82, the "Cancel" button, the "Start" button, the "Time" button, the "Clock" button, and the "Stop" button are located on the left side of user interface 80, while the keypad and its digits "0" to "9" (except "4") are located on the right side of user interface 80. FIG. 10 illustrates user interface as it is displayed alternatively for the z-direction orientation of oven 10 in FIGS. 3 and 4 and oven 110 in FIG. 6. Display device 82 here has been moved to be located above the keypad, while the "Cancel" button, the "Start" button, the "Time" button, the "Clock" button, and the "Stop" button are located in general below the keypad.

In FIGS. 9 and 10, user interface 80 is displayed right-side-up to the user regardless of the orientation of ovens 10 and 110. That is, the digits "0" to "9" and the words "Cancel", "Start", "Time", "Clock" and "Stop" are displayed right-side-up to the user regardless of the orientation of ovens 10 and 110. The user interfaces of FIGS. 9 and 10 also share certain features, such as keeping display device 82 towards the top of user interface 80. The "Time" button, the "Clock" button, and the "Stop" button are located on the bottom of user interface 80 in both FIGS. 9 and 10. The "Cancel" button and the "Start" button are located at or towards the vertical center of user interface 80 in both FIGS. 9 and 10. Such consistency helps the user to work easily with the display changes between FIGS. 9 and 10.

Figure 11:
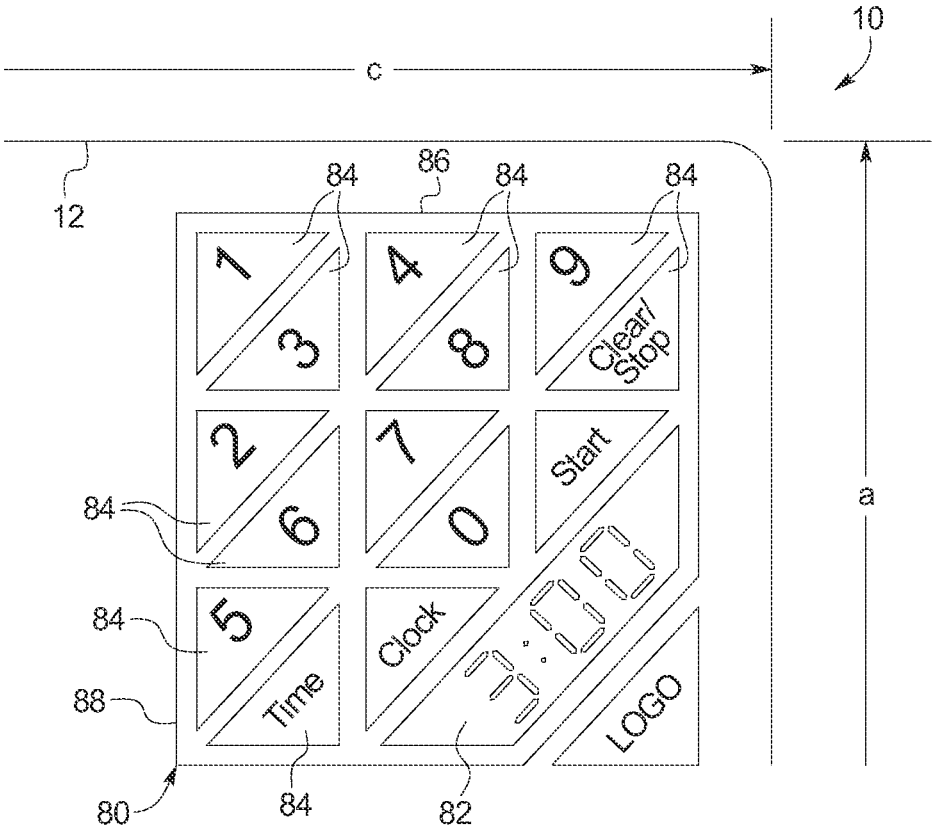
FIG. 11 is an elevation view of another embodiment of a rotatable user interface for use with any of the microwave ovens of the present disclosure.

A further alternative user interface 80 is illustrated in FIG. 11. For reference, dimensions a and c of housing 12 of oven 10 are illustrated. It should be appreciated however that the user interface of FIG. 11 works equally well with ovens 10 and 110. User interface 80 of FIG. 11 does not in the illustrated embodiment use or need a touch screen 84. Touch screen 84 could alternatively be provided, however, in the illustrated embodiment digits 84 and buttons 84 are each electromechanical pushbuttons, such as membrane switches. Membrane switches are desirable because the electrical contacts are sealed from both human touch and cleaning liquids. Membrane switches are also devoid of creases or grooves that can be difficult to clean.

Boundaries 86 and 88 in the illustrated embodiment form a roughly square user interface 80. The digits "0" to "9", the "Time" button, the "Clock" button, the "Start" button and the "Clear/Stop" button are each displayed as triangularly shaped buttons that are disposed at forty-five degrees relative to the user's horizontal site plain, but which are easy to read and discern. Display device 82 of user interface 80 is likewise rotated to forty-five degrees. An area beneath display device 82 but within boundaries 86 and 88 is left available to display and illuminate a logo or other information if desired.

FIG. 11 illustrates user interface 80 as it would appear in the z-direction orientation of microwave oven 10 in FIGS. 3 and 4, in which dimension c extends along the top of oven 10 and dimension a extends along the vertical side of the oven. If oven 10 is rotated or flipped to so that dimension a extends instead along the bottom of oven 10, while dimension c extends instead along the vertical side of oven 10, as is the case in FIG. 1, then the digits "0" to "9", the "Time" button, the "Clock" button, the "Start" button and the "Clear/Stop" button will be rotated ninety degrees. If the page showing FIG. 11 is rotated ninety-degrees clockwise to simulate this flipping of oven 10, it is seen that the numbers and buttons are still somewhat right-side-up to the user and are still easily read and discernible. Neither orientation of oven 10 and user interface 80 therefore requires the user to read or view information that is vertical or upside down relative to the horizontal viewing plane of the user.

The user interface of FIG. 11 is easy to use in any orientation and does not require a touch screen, switches 72 or the associated electronics and programming. For oven 110, it should be appreciated that the user interface 80 of FIG. 11 could be translated or slid into the lower-left corner of oven 110 in the z-direction orientation as shown in FIG. 6, namely, where dimension c of FIG. 6 is now located directly below user interface 80 as opposed to being on the of the user interface in FIG. 11. Dimension a of FIG. 6 would then be the vertical dimension in FIG. 11. If oven 110 is then rotated to the x-y horizontal orientation of FIG. 5, in which the a-dimension is now the bottom dimension, the digits "0" to "9", the "Time" button, the "Clock" button, the "Start" button and the "Clear/Stop" button will again be rotated ninety degrees. If the page showing FIG. 11 is rotated ninety-degrees clockwise to simulate the flipping of oven 110 from the orientation of FIG. 6 to that of FIG. 5, it is again seen that the numbers and buttons are still somewhat right-side-up to the user and are still easily read and discernible. Thus user interface 80 of FIG. 11 is applicable to both ovens 10 and 110.

Duty Cycles

One theme of the present disclosure is to have an oven that is compact, well built and cost effective. Eliminating a moving or motorized part reduces cost, size and eliminates a part that is more susceptible to needing repair or replacement. Microwave ovens are often provided with cooling fans to cool the magnetron. It is contemplated to eliminate such fan and to combat the overheating of magnetron 54 and other microwave components 50 by reducing the size of the components to generate less heat in the first place. Second, it is contemplated to limit the duty cycle of ovens 10 and 110, so that the ovens cannot be used in one session or in succession to the extent that a component, such as magnetron 54, can overheat or even come close to overheating.

One primary use for the ovens 10 and 110 is individual use. For example, ovens 10 and 110 are perfectly suited for an office or work environment. It is not expected that the microwave will be needed for long cooking durations, such as to cook raw rice or a large meat item, which can be the case at home. Ovens 10 and 110 are definitely contemplated for the home, however, e.g., as a basement or secondary microwave, or as a primary microwave in certain environments, such as a college room or apartment environment. Thus it is expected that the user in the vast majority of uses will not encounter or detect a limitation to duty cycle.

Figure 12:
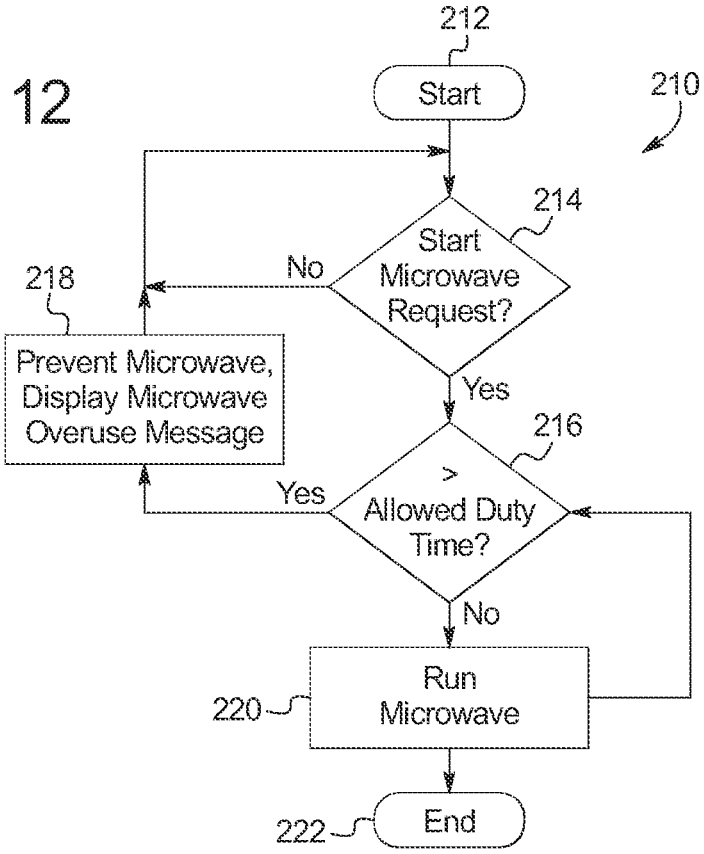
FIG. 12 is a schematic flow diagram illustrating one embodiment for limiting an overall duty cycle for any of the microwave ovens of the present disclosure.
Figure 13:
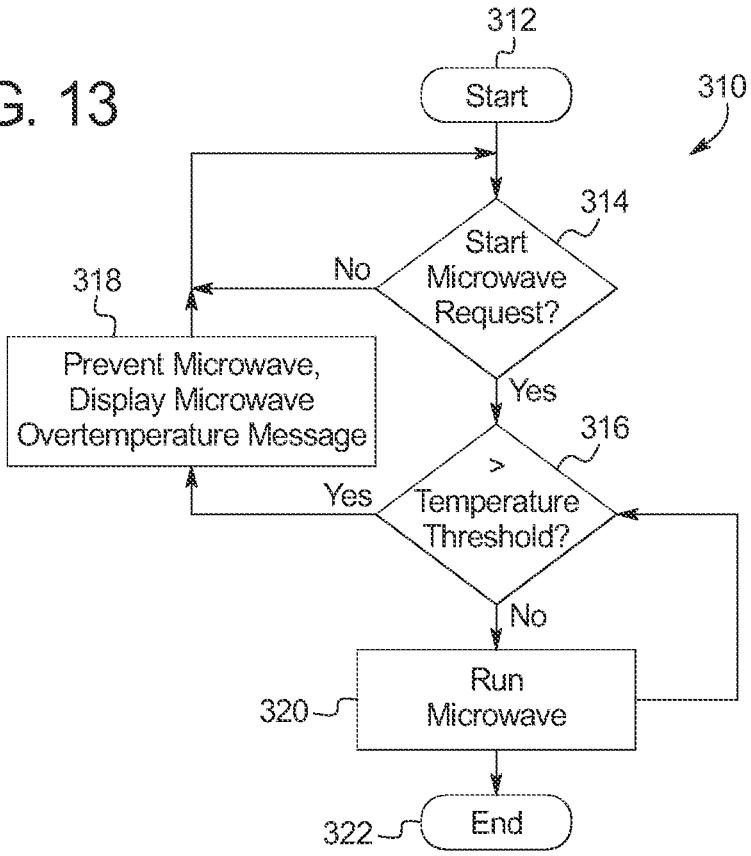
FIG. 13 is a is a schematic flow diagram illustrating another embodiment for limiting an overall duty cycle for any of the microwave ovens of the present disclosure.

Referring now to FIGS. 12 and 13, two different methods 210 and 310 for limiting duty cycle are illustrated. Methods 210 and 310 are operated via processing 102 and memory 104 of control unit via input/output circuitry 112 and temperature sensors 70 (method 310 in FIG. 13 only) to control microwave electronics 50. Method 210 begins at oval 212. At diamond 214, method 210 determines whether the user has selected to start microwave oven 10, 110 (e.g., via pressing the "Start" button in FIGS. 9 to 11). If not, method 210 resets itself back to the beginning of diamond 214. The diamond 214 loop is continued until a start microwave oven request is received.

When a start microwave oven request is finally received, method 210 determines whether oven 10, 110 is currently over an allowed duty time or whether the current request, if allowed to proceed, would send the microwave over the prescribed duty time. Thus, method 210 ideally prevents microwave oven 10, 110 from even beginning a session that would exceed the allowed duty time, but is also capable of handling a situation in which microwave oven 10, 110 has exceeded the allowed duty time.

Allowed duty time can be based upon a percentage of time. For example, method 210 can limit microwave oven 10, 110 to running a percentage of an hour, e.g., to only running between sixty to eighty percent of an hour. Allowed duty time can alternatively or additionally prevent any one session from running past a particular duration. For example, method 210 can prevent the entry of more than, e.g., ten or fifteen minutes, into user interface 80. The single entry prevention may be performed in combination with the percentage limitation, so that the ten or fifteen minute entry for example is not allowed even if the entry would still fall within the allowed percentage level.

As illustrated at diamond 16 and block 218, if the start microwave request would exceed the allowed duty time (exceed percentage and/or exceed single session entry), or if microwave oven 10, 110 has somehow actually exceeded the allowed duty time, then method 210 either prevents microwave oven 10, 110 from beginning operation (request would exceed) or shuts down microwave oven 10, 110 (limit exceeded). At block 218, method 210 also causes microwave 10, 110 to display at display device 82 an overuse message, such as, "duty limit would be exceeded . . . try again later" or "duty limit exceeded . . . resume in X minutes", or some combination of these messages.

The loop created by the decision diamond 216, the prevention or shutdown block 218 and the start microwave request 214 is repeated (assuming the user attempts to use the microwave oven again at diamond 214) until the request would not exceed the allowed duty time or if an actual overlimit has timed out. Although not illustrated in FIG. 12, method 210 can cause the microwave to display a "microwave ready" message whenever microwave 10, 110 is capable of being used, or perhaps only after the user has been precluded from using the microwave. When the microwave is ready to be run as determined at diamond 216, the user can run the microwave as illustrated at block 220. As discussed above, method 210 should prevent an allowed duty time overlimit from ever occurring. If an overlimit should occur during a period in which microwave 10, 110 is running, however, method returns to diamond 216 and shuts the microwave down until the overlimit is cleared, as illustrated by the arrow extending from run block 220 back to the allowed duty time decision diamond 216. If no overlimit occurs during the operation of microwave oven 10, 110 at block 220, the microwave runs for its prescribed time. At oval 222, method 210 ends.

Method 210 operates on a time basis. Method 310 operates instead on a sensed temperature basis using control unit 100 and temperature sensors 70. Method 310 begins at oval 312. At diamond 314, method 310 determines whether the user has selected to start microwave oven 10, 110 (e.g., via pressing the "Start" button in FIGS. 9 to 11). If not, method 310 resets itself back to the beginning of diamond 314. The diamond 314 loop is continued until a start microwave oven request is received.

When a start microwave oven request is finally received, method 310 determines at diamond 316 whether one or more sensed temperature meets or exceeds a temperature limit or threshold. The temperature threshold is based upon an absolute temperature in one embodiment. That is, the limit can be a set temperature (e.g., 100 degrees F. (38 degrees C.)), for which method 310 trips if the actual temperature meets or exceeds the limit. The actual temperature limit can be based upon a reading from one temperature sensor 70 or upon an aggregate or average from multiple temperature sensors 70. An overall temperature limit can be set for the entire oven 10, 110. Or, multiple limits can be set for different components, e.g., a first limit for one or more temperature sensor 70 dedicated to transformer 52 and a second limit (same or different threshold temperature) for one or more temperature sensor 70 dedicated to magnetron 54. Tripping either limit causes the microwave to shut down in one embodiment.

Alternatively, the temperature threshold is a threshold change in temperature or delta temperature. For example, the limit could be tripped if a sensed temperature change (or aggregate or average of multiple sensed temperatures changes) exceed(s) $\Delta X$ degrees F. or $\Delta Y$ degrees C. A temperature delta threshold allows sensor 70 to not have to sense the exact temperature, e.g., to be out of calibration, and still operate with precision under the assumption that a sensor out of calibration still measures temperature changes efficiently. In many cases, microwave oven 10, 110 is used indoors where the temperature is regulated, e.g., to about 70 degrees F. (21 degrees C.). The threshold temperature change can then be set assuming that the beginning microwave temperature is a regulated temperature or within a range of such temperature. Thus if it is desired to shut microwave 10, 110 down when a component reaches for example 100 degrees F. (38 degrees C.)), and ambient temperature is assumed to be regulated at about 70 degrees F. (21 degrees C.), the temperature delta limit can be set to be 30 degrees F. (17 degrees C.).

However, and especially in the case in which microwave oven 10, 110 is used outdoors, and possibly battery operated, microwave oven 10, 110 may be cooled or heated significantly by outside ambient temperatures. It is accordingly contemplated that method 310 employed by processing 102 and memory 104 use a hybrid algorithm in which (i) the temperature change or delta threshold is used if the initially sensed temperature (single or averaged) is within a "standard indoor" range, and (ii) the absolute temperature threshold is used if the initially sensed temperature (single or averaged) is outside the "standard indoor" range.

If any one or more sensed temperature (or average of multiple sensed temperatures) meets or exceeds the temperature threshold (which can be of any one of the types discussed previously), method 310 at diamond 316 prevents microwave oven 10, 110 from either beginning operation or continuing operation as the case may be, as indicated by block 318. At block 318, method 310 operated by control unit 100 can also send a suitable message to user interface display 82, e.g., "oven overheated, please wait". When instead the measured temperature signal or combination of measured signals is or falls (i) below the threshold, (ii) a certain number of degrees or percentage below the threshold, or (iii) for a certain amount of time below the threshold temperature level, method 310 at diamond 316 allows microwave 10, 110 to be operated as indicated at block 320. Although not illustrated in FIG. 13, if an overheat limit is cleared at diamond 316, method 310 can send an appropriate follow-up message at block 320 to display 82, e.g., "oven ready".

Method 310 accordingly allows microwave oven 10, 110 to be used until an excessive temperature level (for a component, for any of a multitude of individually sensed components and/or for the microwave generally) is drawing near. The temperature threshold or temperature delta in any of the embodiments discussed above is accordingly set below a temperature at which (i) any damage could actually occur to a component of microwave 10, 110 or to the microwave generally or (ii) any type of smoke or fire causing temperature can be reached.

At block 320, if a temperature overlimit should occur while microwave 10, 110 is running, method 310 returns to diamond 316 and shuts the microwave down until the temperature overlimit is cleared, as illustrated by the arrow extending from run block 320 back to temperature comparison at diamond 316. If no temperature overlimit occurs during the operation of microwave oven 10, 110 at block 320, microwave oven 10, 110 runs for its prescribed time. At oval 322, method 310 ends.

Heating Pouch

Figure 14:
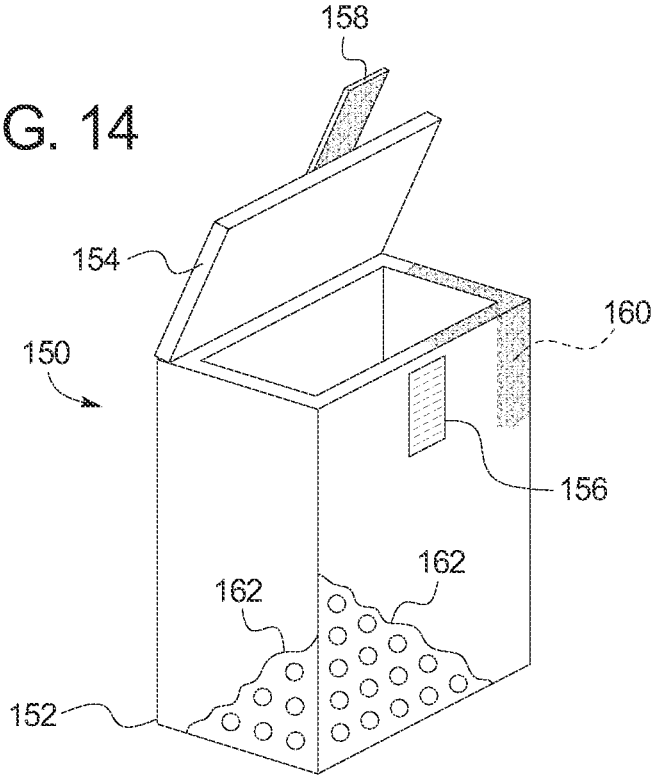
FIG. 14 is a perspective view of one embodiment of a food item carrying, microwaveable, odor-absorbing pouch of the present disclosure.

Referring now to FIG. 14, one embodiment of a food item carrying, microwaveable, odor-absorbing pouch 150 is provided. Pouch 150 includes a base section 152 and a cover 154 that covers an opening provided by base section 152. Base section 152 has five walls in the illustrated embodiment, which are connected together so as to be able to accept a food item, such as food item 42 or 44. Cover 154, which can be hinged to base section 152, e.g., via a living hinge, encloses pouch 150. Pouch 150 can then be releasably sealed closed, e.g., via hook and loop fasteners 156 and 158. Pouch 150 in one embodiment is sized to just fit within the microwaveable space 40, 140.

The walls of base section 152 and cover 154 are in one embodiment flexible and made of a tough material, such as nylon or other rugged, microwaveable polymer. The walls of base section 152 and cover 154 are filled in the illustrated embodiment with an odor-absorbing material, such as an activated carbon powder, activated charcoal, carbon-filled sponge, carbon-filled fiber or other non-carbon, highly absorbent material, e.g., an absorbent polymer. The odor-absorbing walls absorb odors generated by the heated or cooked food, which may be especially desirable in a workplace environment.

Alternatively or additionally, any one or more of the walls of base section 152 and cover 154 can be laminated, painted or printed with a perforated microwave reflective film, paint, ink or paste 162 to help to evenly heat or cook food items 42 and 44 placed within pouch 150. Microwave reflective film, paint, ink or paste 162 may be of any of the types and be applied in any of the manners (e.g., via stencil painting or screen printing) discussed above. Alternatively, the insides of the walls of pouch 150 can hold or secure a perforated microwave reflective material to help to evenly heat or cook food within the pouch.

Additional Aspects of the Present Disclosure

Aspects of the subject matter described herein may be useful alone or in combination one or more other aspect described herein. Without limiting the foregoing description, in a first aspect of the present disclosure a microwave oven includes (i) a housing including two surfaces upon which the microwave oven can be set for operation; (ii) a magnetron located inside the housing; (iii) a door hinged along a hinged surface of the housing; and (iv) a user interface located on a surface of the housing opposing the hinged surface.

In accordance with a second aspect of the present disclosure, which may be used in combination with any one or more other aspect listed herein, the microwave oven includes an x-y horizontal position caused by setting the microwave on a first one of the surfaces and a z-direction position caused by setting the microwave on second one of the surfaces.

In accordance with a third aspect of the present disclosure, which may be used in combination with any one or more other aspect listed herein, at least one of (i) the hinged surface of the housing is different than the two surfaces upon which the microwave oven can be set for operation or (ii) the user interface surface of the housing is different than the two surfaces upon which the microwave oven can be set for operation.

In accordance with a fourth aspect of the present disclosure, which may be used in combination with any one or more other aspect listed herein, the user interface includes at least one button or display oriented forty-five degrees relative to the two surfaces.

In accordance with a fifth aspect of the present disclosure, which may be used in combination with any one or more other aspect listed herein, a microwave oven includes (i) a housing including two surfaces upon which the microwave oven can be set for operation; (ii) electronic components located inside the housing; and (iii) wherein at least one relatively heavy electronic component is positioned such that the component rests near a bottom of the housing regardless of which of the two surfaces the microwave oven is set for operation.

In accordance with a sixth aspect of the present disclosure, which may be used in combination with any one or more other aspect listed herein including the fifth aspect, the at least one relatively heavy electronic component includes a transformer.

In accordance with a seventh aspect of the present disclosure, which may be used in combination with any one or more other aspect listed herein including the fifth aspect, the at least one relatively heavy electronic component includes a magnetron.

In accordance with an eighth aspect of the present disclosure, which may be used in combination with any one or more other aspect listed herein, a microwave oven includes (i) a housing; (ii) a magnetron located inside the housing; (iii) a microwavable space located inside the housing; and (iv) at least one microwave reflecting obstruction placed between the magnetron and the microwavable space to more evenly heat a food item placed in the microwavable space.

In accordance with a ninth aspect of the present disclosure, which may be used in combination with any one or more other aspect listed herein including the eighth aspect, the housing includes two surfaces upon which the microwave oven can be set for operation.

In accordance with a tenth aspect of the present disclosure, which may be used in combination with any one or more other aspect listed herein including the eighth aspect, the microwave oven includes a faraday cage surrounding the microwavable space and at least part of the at least one microwave reflecting obstruction.

In accordance with an eleventh aspect of the present disclosure, which may be used in combination with any one or more other aspect listed herein including the eighth aspect, the microwave reflecting obstruction includes a reflecting rod or a perforated wall or layer.

In accordance with a twelfth aspect of the present disclosure, which may be used in combination with any one or more other aspect listed herein, a microwave oven includes (i) a housing including two surfaces upon which the microwave oven can be set for operation; (ii) a magnetron located inside the housing; and (iii) a user interface positioned along a surface of the housing, at least a portion of the user interface rotatable to display information right-side-up regardless of which of the two surfaces the microwave oven is set for operation.

In accordance with a thirteenth aspect of the present disclosure, which may be used in combination with any one or more other aspect listed herein including the twelfth aspect, the information includes a countdown of remaining time for heating.

In accordance with a fourteenth aspect of the present disclosure, which may be used in combination with any one or more other aspect listed herein including the twelfth aspect, the user interface includes a display device, the information displayed by the display device, and at least one electromechanical button for entering a value displayed by the display device.

In accordance with a fifteenth aspect of the present disclosure, which may be used in combination with any one or more other aspect listed herein including the twelfth aspect, the user interface includes a touch screen, the information provided in a time entry display area of the touch screen and on at least one touch screen button.

In accordance with a sixteenth aspect of the present disclosure, which may be used in combination with any one or more other aspect listed herein including the twelfth aspect, the information is rotated in response to an output of a gravity switch.

In accordance with a seventeenth aspect of the present disclosure, which may be used in combination with any one or more other aspect listed herein including the twelfth aspect, the information is rotated in response to at least one output of at least one electrical contact switch associated with at least one of the two surfaces upon which the microwave oven can be set for operation.

In accordance with an eighteenth aspect of the present disclosure, which may be used in combination with any one or more other aspect listed herein including the seventeenth aspect, the at least one electrical contact switch is provided with at least one foot along at least one of the two surfaces.

In accordance with a nineteenth aspect of the present disclosure, which may be used in combination with any one or more other aspect listed herein, a microwave oven includes (i) a housing; (ii) a heat generating microwave component located inside the housing; (iii) a temperature sensor associated with the heat generating microwave component; and (iv) a control unit located inside the housing, the control unit receiving an output from the temperature sensor and configured to use the output to determine whether the heat generating microwave component can be currently operated.

In accordance with a twentieth aspect of the present disclosure, which may be used in combination with any one or more other aspect listed herein including the nineteenth aspect, the housing includes two surfaces upon which the microwave oven can be set for operation.

In accordance with a twenty-first aspect of the present disclosure, which may be used in combination with any one or more other aspect listed herein including the nineteenth aspect, the heat generating microwave component is a magnetron.

In accordance with a twenty-second aspect of the present disclosure, which may be used in combination with any one or more other aspect listed herein including the nineteenth aspect, the output is used by the control unit to be compared to a threshold temperature or to a threshold change in temperature.

In accordance with a twenty-third aspect of the present disclosure, which may be used in combination with any one or more other aspect listed herein including the nineteenth aspect, the temperature sensor is placed on or near the heat generating microwave component.

In accordance with a twenty-fourth aspect of the present disclosure, which may be used in combination with any one or more other aspect listed herein including the nineteenth aspect, microwave oven includes a plurality of temperature sensors producing a combined output used by the control unit.

In accordance with a twenty-fifth aspect of the present disclosure, which may be used in combination with any one or more other aspect listed herein including the twenty-fourth aspect, the combined output is formed by the control unit.

In accordance with a twenty-sixth aspect of the present disclosure, which may be used in combination with any one or more other aspect listed herein, a microwave oven includes (i) a housing including dimensions a×b×c, wherein a and b are larger than c, and wherein the housing can be set for operation on a surface in which one of the dimensions is c; and (ii) a user interface including at least one pressable button, the user interface located on a surface of the housing defined by the dimensions a×c or b×c.

In accordance with a twenty-seventh aspect of the present disclosure, which may be used in combination with any one or more other aspect listed herein including the twenty-sixth aspect, the surface is a first surface upon which the housing can be set for operation, and which includes a second surface upon which the housing can be set for operation.

In accordance with a twenty-eighth aspect of the present disclosure, which may be used in combination with any one or more other aspect listed herein including the twenty-seventh aspect, the second surface includes dimensions a×b.

In accordance with a twenty-ninth aspect of the present disclosure, which may be used in combination with any one or more other aspect listed herein, a microwave oven includes (i) a housing; (ii) an electrically operated microwave component located inside the housing; (iii) an alternating current ("AC") power input supported by the input; (iv) a battery rechargeable via the AC power input; and (v) a control unit located inside the housing and configured to selectively power the electrically operated microwave component via the AC power input or the battery.

In accordance with a thirtieth aspect of the present disclosure, which may be used in combination with any one or more other aspect listed herein including the twenty-ninth aspect, the AC power input is a plug or a socket.

In accordance with a thirty-first aspect of the present disclosure, which may be used in combination with any one or more other aspect listed herein including the twenty-ninth aspect, the control unit is configured to power the electrically operated microwave component via the AC power input if connected to an external AC source or via the battery if the AC power input is not connected to the external AC source.

In accordance with a thirty-second aspect of the present disclosure, which may be used in combination with any one or more other aspect listed herein including the twenty-ninth aspect, the control unit is configured to automatically recharge the rechargeable battery if needed and if the AC power input is connected to an external AC source.

In accordance with a thirty-third aspect of the present disclosure, which may be used in combination with any one or more other aspect listed herein including the twenty-ninth aspect, the microwave oven includes a user interface, and wherein the AC power input is located on a surface of the housing that opposes a surface on which the user interface is located.

In accordance with a thirty-fourth aspect of the present disclosure, which may be used in combination with any one or more other aspect listed herein including the twenty-ninth aspect, the housing includes two surfaces upon which the microwave oven can be set for operation, and wherein the AC power input is located on a surface of the housing different from the two surfaces upon which the microwave oven can be set for operation.

In accordance with a thirty-fifth aspect of the present disclosure, which may be used in combination with any one or more other aspect listed herein, a microwave oven includes (i) a housing including two surfaces upon which the microwave oven can be set for operation; (ii) a magnetron located inside the housing; (iii) a first plurality of impact-absorbing feet placed on a first of the two surfaces; and (iv) a second plurality of impact-absorbing feet placed on a second of the two surfaces.

In accordance with a thirty-sixth aspect of the present disclosure, which may be used in combination with any one or more other aspect listed herein including the thirty-fifth aspect, the impact-absorbing feet are rubber feet.

In accordance with a thirty-seventh aspect of the present disclosure, any of the structure and functionality illustrated in and discussed in connection with FIGS. 1 to 14 may be used in combination with any one or more other aspect listed herein.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A microwave oven comprising:

a housing including first and second outer surfaces upon which the microwave oven can be set for operation;

a magnetron located inside the housing;

a wall located within the housing and between a microwavable space and the magnetron, the wall forming a portion of the microwavable space and providing a surface upon which a food item is placed when the housing is set on one of the first or second surfaces for operation;

a door hinged along a hinged outer surface of the housing, the hinged outer surface different than the first and second outer surfaces; and a user interface located on an outer surface of the housing, the user interface outer surface separated from the hinged outer surface by the first and second surfaces.

2. The microwave oven of claim 1, which includes an x-y horizontal position caused by setting the microwave on one of the first or second surfaces and a z-direction position caused by setting the microwave on the other of the first or second outer surfaces.

3. The microwave oven of claim 1, which is rectangular.

4. The microwave oven of claim 1, wherein the user interface includes at least one button or display oriented forty-five degrees relative to the first and second outer surfaces.

5. A microwave oven comprising:

a housing including two surfaces upon which the microwave oven can be set for operation;

a user interface side of the housing different from the sides associated with the two surfaces upon which the microwave oven can be set for operation;

electronic components located inside the housing, wherein at least one relatively heavy electronic component is positioned such that the component rests near a bottom of the housing regardless of which of the two surfaces the microwave oven is set for operation; and a wall located within the housing and between a microwavable space and the at least one relatively heavy electronic component, the wall forming a portion of the microwavable space and providing a surface upon which a food item is placed when the housing is set on one of the two surfaces for operation.

6. The microwave oven of claim 5, wherein the at least one relatively heavy electronic component includes a transformer.

7. The microwave oven of claim 5, wherein the at least one relatively heavy electronic component includes a magnetron.

8. A microwave oven comprising:

a housing including a door located on a door side of the housing and a user interface located on a user interface side of the housing different from the door side of the housing;

a magnetron located inside the housing;

a microwavable space located inside the housing, the microwavable space defined by at least one wall inside the housing separating the microwavable space from the magnetron, wherein the at least one wall is located between the microwavable space and the magnetron and provides a surface upon which a food item is placed when the housing is set for operation; and at least one microwave reflecting obstruction placed between the magnetron and the inner wall of the microwavable space to more evenly heat a food item placed in the microwavable space.

9. The microwave oven of claim 8, wherein the housing includes two surfaces upon which the microwave oven can be set for operation.

10. The microwave oven of claim 8, which includes a faraday cage surrounding the microwavable space and at least part of the at least one microwave reflecting obstruction.

11. The microwave oven of claim 8, wherein the microwave reflecting obstruction includes a reflecting rod or a perforated wall or layer.

12. A microwave oven comprising:

a housing including two surfaces upon which the microwave oven can be set for operation;

a magnetron located inside the housing;

a wall located within the housing and between a microwavable space and the magnetron, the wall forming a portion of the microwavable space and providing a surface upon which a food item is placed when the housing is set on one of the two surfaces for operation; and a user interface positioned along a side of the housing different from the two surfaces upon which the microwave oven can be set for operation, at least a portion of the user interface rotatable to display information right-side-up regardless of which of the two surfaces the microwave oven is set for operation.

13. The microwave oven of claim 12, wherein the information includes a countdown of remaining time for heating.

14. The microwave oven of claim 12, wherein the user interface includes a display device, the information displayed by the display device, and at least one electromechanical button for entering a value displayed by the display device.

15. The microwave oven of claim 12, wherein the user interface includes a touch screen, the information provided in a time entry display area of the touch screen and on at least one touch screen button.

16. The microwave oven of claim 12, wherein the information is rotated in response to an output of a gravity switch.

17. The microwave oven of claim 12, wherein the information is rotated in response to at least one output of at least one electrical contact switch associated with at least one of the two surfaces upon which the microwave oven can be set for operation.

18. The microwave oven of claim 17, wherein the at least one electrical contact switch is provided with at least one foot along at least one of the two surfaces.

19. A microwave oven comprising:

a housing including a door located on a door side of the housing and a user interface located on a user interface side of the housing different from the door side of the housing;

a heat generating microwave component including a magnetron located inside the housing;

a temperature sensor associated with the heat generating microwave component;

a wall located within the housing and between a microwavable space and the heat generating component, the wall forming a portion of the microwavable space and providing a surface upon which a food item is placed when the housing is set for operation; and a control unit located inside the housing, the control unit receiving an output from the temperature sensor and configured to use the output to determine whether the heat generating microwave component can be currently operated.

20. The microwave oven of claim 19, wherein the housing includes two surfaces upon which the microwave oven can be set for operation.

21. The microwave oven of claim 19, wherein the wall further separates the microwavable space from the temperature sensor.

22. The microwave oven of claim 19, wherein the output is used by the control unit to be compared to a threshold temperature or to a threshold change in temperature.

23. The microwave oven of claim 19, wherein the temperature sensor is placed on or near the heat generating microwave component.

24. The microwave oven of claim 19, which includes a plurality of temperature sensors producing a combined output used by the control unit.

25. The microwave oven of claim 24, wherein the combined output is formed by the control unit.

26. A microwave oven comprising:

a housing including dimensions a×b×c, wherein a and b are larger than c, and wherein the housing can be set for operation selectively and alternatively on a surface defined by the dimensions a×b or b×c;

a magnetron;

a wall located within the housing and between a microwavable space and the magnetron, the wall forming a portion of the microwavable space and positioned to receive a food item when the housing is set on the surface defined by the dimensions a×b or b×c; and a user interface including at least one pressable button, the user interface located on a surface of the housing defined by the dimensions a×c.

27. The microwave oven of claim 26, wherein the surface is a first surface upon which the housing can be set for operation, and which includes a second surface upon which the housing can be set for operation.

28. The microwave oven of claim 27, wherein the second surface includes dimensions a×b.

29. A microwave oven comprising:

a housing;

an electrically operated microwave component including a magnetron located inside the housing;

a wall located within the housing and between a microwavable space and the electrically operated microwavable component, the wall forming a portion of the microwavable space and providing a surface upon which a food item is placed when the housing is set for operation;

an alternating current ("AC") power input supported by the housing;

a battery rechargeable via the AC power input; and a control unit located inside the housing and configured to selectively power the electrically operated microwave component via the AC power input or the battery.

30. The microwave oven of claim 29, wherein the AC power input is a plug or a socket.

31. The microwave oven of claim 29, wherein the control unit is configured to power the electrically operated microwave component via the AC power input if connected to an external AC source or via the battery if the AC power input is not connected to the external AC source.

32. The microwave oven of claim 29, wherein the control unit is configured to automatically recharge the rechargeable battery if needed and if the AC power input is connected to an external AC source.

33. The microwave oven of claim 29, which includes a user interface, and wherein the AC power input is located on a surface of the housing that opposes a surface on which the user interface is located.

34. The microwave oven of claim 29, wherein the housing includes two surfaces upon which the microwave oven can be set for operation, and wherein the AC power input is located on a surface of the housing different from the two surfaces upon which the microwave oven can be set for operation.

35. A microwave oven comprising:

a housing including two surfaces upon which the microwave oven can be set for operation;

a magnetron located inside the housing;

a wall located within the housing and between a microwavable space and the magnetron, the wall forming a portion of the microwavable space and providing a surface upon which a food item is placed when the housing is set on one of the two surfaces for operation;

a first plurality of impact-absorbing feet placed on a first of the two surfaces; and a second plurality of impact-absorbing feet placed on a second of the two surfaces.

36. The microwave oven of claim 35, wherein the impact-absorbing feet are rubber feet.

* * * * *